US008469862B2

(12) United States Patent
Andren et al.

(10) Patent No.: US 8,469,862 B2
(45) **Date of Patent: *Jun. 25, 2013**

(54) WEARABLE DEVICE ASSEMBLY HAVING ATHLETIC FUNCTIONALITY

(75) Inventors: Bo Stefan Andren, Portland, OR (US); Stephen D. Berry, Beaverton, OR (US); Maximillian P. Burton, Portland, OR (US); Matt Capozzi, Portland, OR (US); James A. Ishihara, Beaverton, OR (US); Kevin Lozeau, Barcelona (ES); Hector Moll-Carrillo, Portland, OR (US); James Molyneux, Portland, OR (US); Aaron B. Weast, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/338,721

(22) Filed: Dec. 28, 2011

(65) Prior Publication Data

US 2012/0101602 A1 Apr. 26, 2012

Related U.S. Application Data

(63) Continuation of application No. 12/205,408, filed on Sep. 5, 2008, now Pat. No. 8,088,043.

(60) Provisional application No. 60/970,773, filed on Sep. 7, 2007.

(51) Int. Cl.
*A63B 71/00* (2006.01)

(52) U.S. Cl.
USPC ..... 482/8; 482/1

(58) Field of Classification Search
USPC ..... 482/8
See application file for complete search history.

(56) References Cited

U.S. PATENT DOCUMENTS

| | | | |
|---|---|---|---|
| 1,169,999 | A | 2/1916 | Richards |
| 1,170,767 | A | 2/1916 | Lott |
| 1,559,165 | A | 10/1925 | Hammond |
| 1,748,609 | A | 2/1930 | Lester |
| 1,851,491 | A | 3/1932 | Brown |
| 2,237,675 | A | 4/1941 | Lazrus |
| 2,240,993 | A | 5/1941 | Lazrus |
| 2,255,999 | A | 9/1941 | Kuehner |

(Continued)

FOREIGN PATENT DOCUMENTS

| | | |
|---|---|---|
| CN | 2141693 | 9/1993 |
| JP | 2001506827 | 5/2001 |

(Continued)

OTHER PUBLICATIONS

Chinese Office Action in related Chinese Application No. 200810177842.9; issued Mar. 30, 2012.

(Continued)

*Primary Examiner* — Loan Thanh
*Assistant Examiner* — Shila Jalalzadeh Abyane
(74) *Attorney, Agent, or Firm* — Banner & Witcoff, Ltd.

(57) ABSTRACT

A wearable device has a carrier having an aperture. A device has a USB connection and a protrusion wherein the protrusion is received in the aperture to connect the device to the carrier. The device is a USB type device having athletic functionality.

10 Claims, 25 Drawing Sheets

U.S. PATENT DOCUMENTS

| | | | | |
|---|---|---|---|---|
| 2,629,981 | A | 3/1953 | Melik-Minassiantz | |
| 2,653,442 | A | 9/1953 | Kupchick | |
| 2,749,634 | A | 6/1956 | Billett et al. | |
| 3,009,381 | A | 11/1961 | Rapata | |
| 3,034,189 | A | 5/1962 | Twentier | |
| 3,094,757 | A | 6/1963 | Blake | |
| 3,109,212 | A | 11/1963 | Emery | |
| 3,160,158 | A | 12/1964 | Rayhart | |
| 3,208,238 | A | 9/1965 | Spitzer | |
| 3,372,500 | A | 3/1968 | Claude | |
| 3,421,341 | A | 1/1969 | Hodge | |
| 3,668,890 | A | 6/1972 | Broido | |
| 3,677,450 | A | 7/1972 | Hodgson | |
| 3,769,726 | A | 11/1973 | Spence | |
| 3,786,391 | A | 1/1974 | Mathauser | |
| 3,983,690 | A | 10/1976 | McClintock | |
| 4,048,796 | A | 9/1977 | Sasaki | |
| 4,055,755 | A | 10/1977 | Nakamura et al. | |
| 4,059,956 | A | 11/1977 | Maeda et al. | |
| 4,064,688 | A | 12/1977 | Sasaki et al. | |
| 4,090,353 | A | 5/1978 | Maeda et al. | |
| 4,092,821 | A * | 6/1978 | Wirz | 368/204 |
| 4,120,036 | A | 10/1978 | Maeda et al. | |
| 4,139,837 | A | 2/1979 | Liljenwall et al. | |
| 4,178,751 | A * | 12/1979 | Liautaud | 368/281 |
| 4,198,772 | A | 4/1980 | Furutu | |
| 4,207,479 | A | 6/1980 | Yamamoto et al. | |
| 4,221,063 | A | 9/1980 | Charles et al. | |
| 4,247,929 | A | 1/1981 | Sasaki et al. | |
| 4,255,802 | A | 3/1981 | Ogawa | |
| 4,257,115 | A | 3/1981 | Hatuse et al. | |
| 4,257,117 | A | 3/1981 | Besson | |
| 4,281,406 | A | 7/1981 | Tanaka | |
| 4,300,204 | A | 11/1981 | Maeda et al. | |
| 4,322,833 | A | 3/1982 | Husted | |
| 4,464,854 | A | 8/1984 | Hall | |
| 4,477,797 | A | 10/1984 | Nakagiri | |
| 4,611,368 | A | 9/1986 | Battersby | |
| 4,671,671 | A | 6/1987 | Suetaka | |
| 4,770,008 | A | 9/1988 | Yamaura | |
| 4,974,429 | A | 12/1990 | Ferrara | |
| 5,088,070 | A | 2/1992 | Shiff | |
| 5,179,733 | A | 1/1993 | Matsui | |
| 5,226,809 | A | 7/1993 | Franco | |
| 5,410,784 | A | 5/1995 | Katz | |
| 5,487,053 | A | 1/1996 | Beiswenger et al. | |
| 5,493,805 | A | 2/1996 | Penuela et al. | |
| 5,504,474 | A * | 4/1996 | Libman et al. | 340/573.4 |
| 5,526,006 | A | 6/1996 | Akahane | |
| 5,640,857 | A | 6/1997 | Halik | |
| 5,689,867 | A | 11/1997 | Katz | |
| 5,722,260 | A | 3/1998 | Mangano | |
| 5,758,443 | A | 6/1998 | Pedrazzini | |
| 5,790,477 | A | 8/1998 | Hauke | |
| 5,831,535 | A | 11/1998 | Reisman et al. | |
| 5,940,349 | A | 8/1999 | Stewart | |
| 6,077,193 | A | 6/2000 | Buhler et al. | |
| 6,085,449 | A | 7/2000 | Tsui | |
| 6,094,403 | A * | 7/2000 | Tran et al. | 368/10 |
| 6,158,884 | A | 12/2000 | Lebby et al. | |
| 6,215,985 | B1 | 4/2001 | Tolvanen | |
| 6,243,870 | B1 | 6/2001 | Graber | |
| 6,324,053 | B1 | 11/2001 | Kamijo | |
| 6,331,965 | B1 | 12/2001 | Sato et al. | |
| 6,359,838 | B1 | 3/2002 | Taylor | |
| 6,446,466 | B1 | 9/2002 | Headley | |
| 6,477,117 | B1 | 11/2002 | Narayanaswami et al. | |
| 6,510,988 | B1 | 1/2003 | Kraus | |
| 6,522,534 | B1 | 2/2003 | Wu | |
| 6,525,997 | B1 | 2/2003 | Narayanaswami et al. | |
| 6,527,610 | B1 | 3/2003 | Hornsby et al. | |
| 6,535,941 | B1 | 3/2003 | Kruse | |
| 6,540,563 | B1 | 4/2003 | Hu et al. | |
| 6,556,222 | B1 | 4/2003 | Narayanaswami | |
| 6,585,622 | B1 | 7/2003 | Shum et al. | |
| 6,603,708 | B2 | 8/2003 | Tamagawa et al. | |
| 6,619,835 | B2 | 9/2003 | Kita | |
| 6,639,791 | B2 | 10/2003 | Su | |
| 6,701,583 | B1 | 3/2004 | McCullough | |
| 6,714,486 | B2 | 3/2004 | Biggs | |
| 6,728,166 | B2 | 4/2004 | Grupp | |
| 6,733,329 | B2 | 5/2004 | Yang | |
| 6,736,759 | B1 | 5/2004 | Stubbs et al. | |
| 6,743,030 | B2 | 6/2004 | Lin et al. | |
| 6,745,069 | B2 | 6/2004 | Nissil et al. | |
| 6,760,003 | B1 | 7/2004 | Sase | |
| 6,763,410 | B2 | 7/2004 | Yu | |
| 6,773,192 | B1 | 8/2004 | Chao | |
| 6,801,476 | B2 | 10/2004 | Gilmour | |
| 6,804,977 | B1 | 10/2004 | Grabelle | |
| 6,812,845 | B2 | 11/2004 | Yuzuki | |
| 6,816,440 | B2 | 11/2004 | Born et al. | |
| D502,216 | S | 2/2005 | Chen | |
| 6,853,304 | B2 | 2/2005 | Reisman | |
| 6,895,261 | B1 | 5/2005 | Palamides | |
| 6,898,550 | B1 * | 5/2005 | Blackadar et al. | 702/182 |
| 6,963,468 | B2 | 11/2005 | Chang et al. | |
| 6,967,903 | B2 | 11/2005 | Guanter | |
| 6,970,157 | B2 | 11/2005 | Siddeeq | |
| 6,977,868 | B2 | 12/2005 | Brewer et al. | |
| 6,980,204 | B1 | 12/2005 | Hawkins et al. | |
| 6,983,888 | B2 | 1/2006 | Weng | |
| 6,997,852 | B2 | 2/2006 | Watterson et al. | |
| 7,006,408 | B2 | 2/2006 | Chen | |
| 7,029,193 | B1 | 4/2006 | Chao | |
| 7,030,735 | B2 | 4/2006 | Chen | |
| 7,031,226 | B2 | 4/2006 | Farine | |
| 7,031,228 | B2 | 4/2006 | Born et al. | |
| 7,035,170 | B2 | 4/2006 | Narayanaswami et al. | |
| 7,042,804 | B2 | 5/2006 | Guanter | |
| 7,079,452 | B2 | 7/2006 | Harrison | |
| 7,081,905 | B1 | 7/2006 | Raghunath | |
| 7,113,451 | B1 | 9/2006 | Matthey | |
| 7,177,234 | B1 | 2/2007 | Paul | |
| 7,221,624 | B2 | 5/2007 | Harrison, Jr. | |
| D545,220 | S * | 6/2007 | Leung | D10/31 |
| 7,234,010 | B2 | 6/2007 | Gilmour | |
| D545,896 | S | 7/2007 | Qiu | |
| D547,374 | S | 7/2007 | Deng | |
| 7,242,639 | B2 | 7/2007 | Blondeau et al. | |
| 7,249,978 | B1 | 7/2007 | Ni | |
| 7,254,516 | B2 | 8/2007 | Case, Jr. et al. | |
| D553,130 | S | 10/2007 | Fiorentino et al. | |
| 7,280,844 | B2 | 10/2007 | Ikeda et al. | |
| 7,293,332 | B2 | 11/2007 | Maillard | |
| 7,311,526 | B2 | 12/2007 | Rohrbach et al. | |
| 7,331,793 | B2 | 2/2008 | Hernandez et al. | |
| D564,904 | S | 3/2008 | Leung | |
| 7,351,066 | B2 | 4/2008 | DiFonzo et al. | |
| D572,151 | S | 7/2008 | Fasciano | |
| 7,529,155 | B2 | 5/2009 | Fasciano | |
| 7,617,071 | B2 | 11/2009 | Darley et al. | |
| 8,088,043 | B2 | 1/2012 | Andren et al. | |
| 8,115,621 | B2 | 2/2012 | Rajala et al. | |
| 2003/0148797 | A1 | 8/2003 | Huang | |
| 2003/0197678 | A1 | 10/2003 | Siddeeq | |
| 2003/0208382 | A1 | 11/2003 | Westfall | |
| 2003/0214885 | A1 | 11/2003 | Powell et al. | |
| 2004/0057578 | A1 | 3/2004 | Brewer | |
| 2004/0083320 | A1 | 4/2004 | Yu | |
| 2004/0103000 | A1 | 5/2004 | Owurowa et al. | |
| 2004/0151071 | A1 | 8/2004 | Kocher | |
| 2004/0198554 | A1 | 10/2004 | Orr et al. | |
| 2004/0233786 | A1 | 11/2004 | Ting | |
| 2004/0264301 | A1 | 12/2004 | Howard et al. | |
| 2005/0007337 | A1 | 1/2005 | Sellen et al. | |
| 2005/0075213 | A1 | 4/2005 | Arick | |
| 2005/0083315 | A1 | 4/2005 | Pei | |
| 2005/0108059 | A1 | 5/2005 | Tay | |
| 2005/0209887 | A1 | 9/2005 | Pollner | |
| 2005/0227811 | A1 * | 10/2005 | Shum et al. | 482/1 |
| 2005/0228244 | A1 | 10/2005 | Banet | |
| 2005/0235539 | A1 | 10/2005 | Story | |
| 2006/0010012 | A1 | 1/2006 | Franzblau et al. | |
| 2006/0012566 | A1 | 1/2006 | Siddeeq | |
| 2006/0015368 | A1 | 1/2006 | Hockey | |
| 2006/0022833 | A1 | 2/2006 | Ferguson et al. | |

| | | | |
|---|---|---|---|
| 2006/0035480 | A1 | 2/2006 | Boyd et al. |
| 2006/0063980 | A1 | 3/2006 | Hwang et al. |
| 2006/0080137 | A1 | 4/2006 | Chambers et al. |
| 2006/0088171 | A1 | 4/2006 | Yeh |
| 2006/0092177 | A1 | 5/2006 | Blasko |
| 2006/0103642 | A1 | 5/2006 | Hawkins et al. |
| 2006/0140055 | A1 | 6/2006 | Ehrsam et al. |
| 2006/0145663 | A1 | 7/2006 | Shiff et al. |
| 2006/0153409 | A1 | 7/2006 | Yeh |
| 2006/0170649 | A1 | 8/2006 | Kosugi et al. |
| 2006/0221772 | A1 | 10/2006 | Vuilleumier et al. |
| 2006/0261958 | A1 | 11/2006 | Klein |
| 2007/0016452 | A1 | 1/2007 | Wilson |
| 2007/0021269 | A1 | 1/2007 | Shum |
| 2007/0030442 | A1 | 2/2007 | Howell et al. |
| 2007/0033717 | A1 | 2/2007 | Anderson |
| 2007/0033838 | A1 | 2/2007 | Luce et al. |
| 2007/0058295 | A1 | 3/2007 | Lasser |
| 2007/0064542 | A1 | 3/2007 | Fukushima |
| 2007/0066088 | A1 | 3/2007 | Rambosek et al. |
| 2007/0071643 | A1 | 3/2007 | Hall et al. |
| 2007/0072442 | A1 | 3/2007 | DiFonzo et al. |
| 2007/0073178 | A1 | 3/2007 | Browning et al. |
| 2007/0073936 | A1 | 3/2007 | Cardenas et al. |
| 2007/0080935 | A1 | 4/2007 | Hanson et al. |
| 2007/0100935 | A1 | 5/2007 | Miyazaki et al. |
| 2007/0104032 | A1 | 5/2007 | Falkenstein et al. |
| 2007/0200716 | A1 | 8/2007 | Haase et al. |
| 2007/0206365 | A1 | 9/2007 | Shiu et al. |
| 2007/0221140 | A1 | 9/2007 | Warren et al. |
| 2007/0245465 | A1 | 10/2007 | Neal et al. |
| 2007/0252811 | A1 | 11/2007 | Arche et al. |
| 2007/0265541 | A1 | 11/2007 | Hung |
| 2007/0287302 | A1 | 12/2007 | Lindberg et al. |
| 2008/0016738 | A1 | 1/2008 | Talbott et al. |
| 2008/0046179 | A1 | 2/2008 | Mackintosh et al. |
| 2008/0112270 | A1 | 5/2008 | Yeh et al. |
| 2008/0153670 | A1 | 6/2008 | McKirdy et al. |
| 2008/0214360 | A1 | 9/2008 | Stirling et al. |
| 2009/0018456 | A1 | 1/2009 | Hung |
| 2009/0177835 | A1 | 7/2009 | Ma et al. |
| 2010/0217096 | A1 | 8/2010 | Nanikashvili |

FOREIGN PATENT DOCUMENTS

| | | |
|---|---|---|
| JP | 2003175139 | 6/2003 |
| JP | 2003289364 | 10/2003 |
| JP | 3098803 | 3/2004 |
| JP | 2004261608 | 9/2004 |
| JP | 2008527324 | 7/2008 |
| WO | 9827702 | 6/1998 |
| WO | 2004100059 | 11/2004 |
| WO | 2006072968 | 7/2006 |
| WO | WO 2006072968 A1 * | 7/2006 |
| WO | 2007064735 | 6/2007 |

OTHER PUBLICATIONS

U.S. Final Office Action in related U.S. Appl. No. 12/205,399; mailed Apr. 6, 2012.

Japanese Office Action in related Japanese Application No. 2010-524188, issued Jul. 20, 2011.

International Search Report in corresponding PCT Application No. PCT/US2008/075419, dated Dec. 23, 2008.

Chinese Office Action in related Chinese Application No. 200810177842.9, dated Mar. 30, 2011.

Japanese Office Action in related Japanese Application No. 2010-524188, dispatch date: Nov. 17, 2011.

U.S. Final Office Action in related U.S. Appl. No. 12/205,396, dated Jan. 31, 2012.

Non-Final Office Action in related U.S. Appl. No. 12/205,392; mailed Jul. 5, 2012.

Japanese Office Action from Japanese Patent Application No. 2010-524188; issued Mar. 21, 2013.

Non-Final Office Action in related U.S. Appl. No. 12/205,396; mailed Feb. 27, 2013.

European Office Action in related European Patent Application No. 08829140.6; dated Feb. 5, 2013.

* cited by examiner

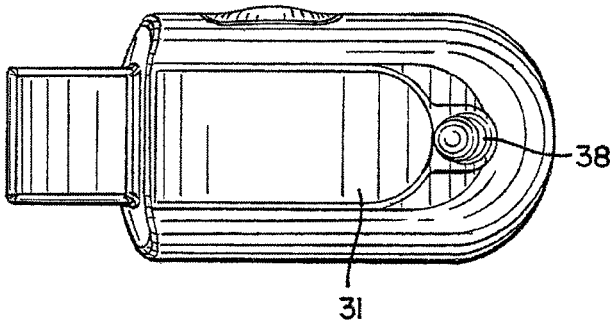
FIG. 9
FIG. 10
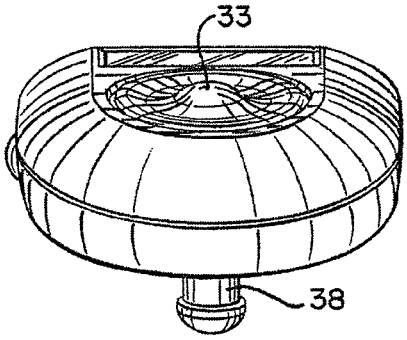
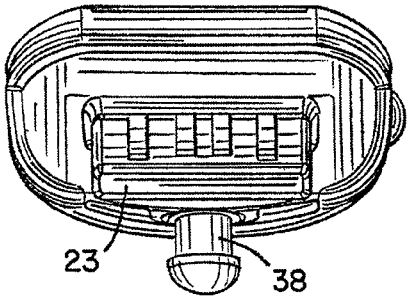
FIG. 11
FIG. 12
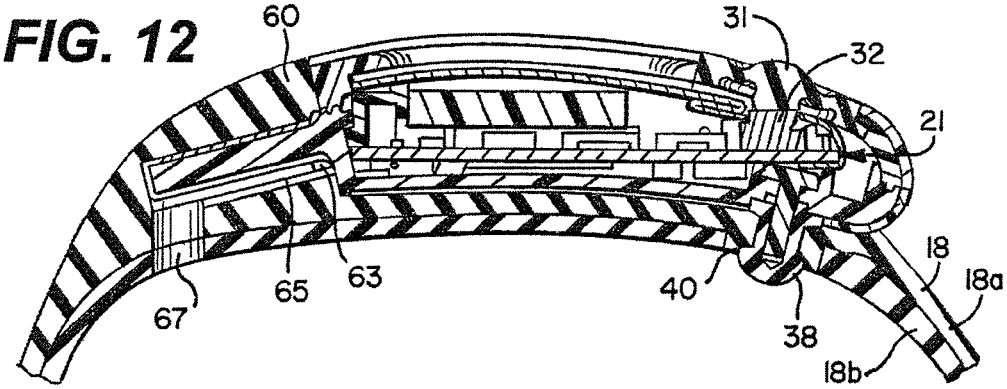

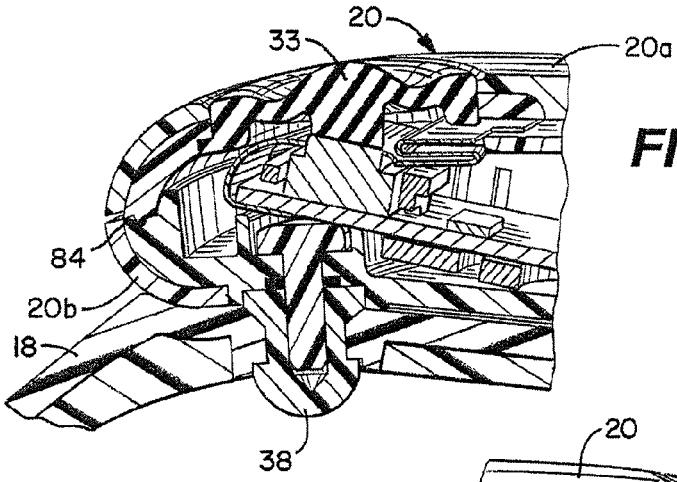
FIG. 28
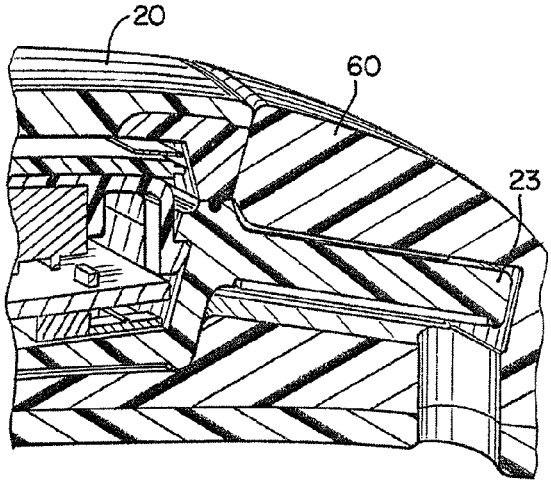
FIG. 29
FIG. 30
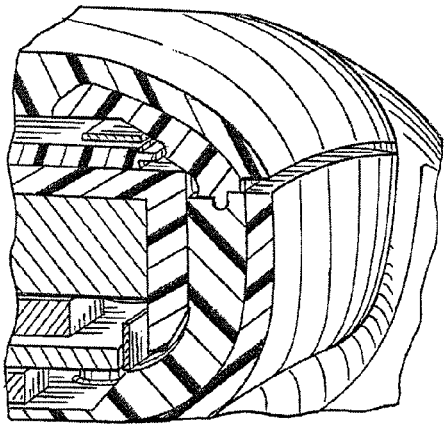
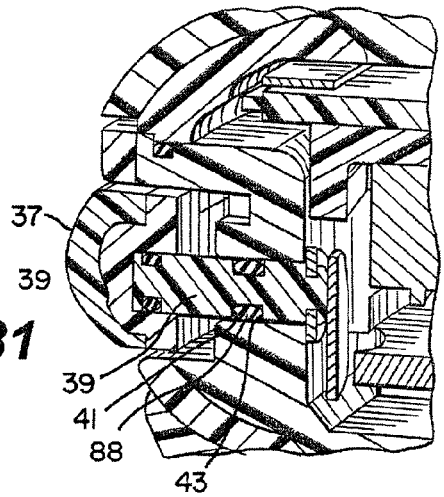
FIG. 31

FIG. 40
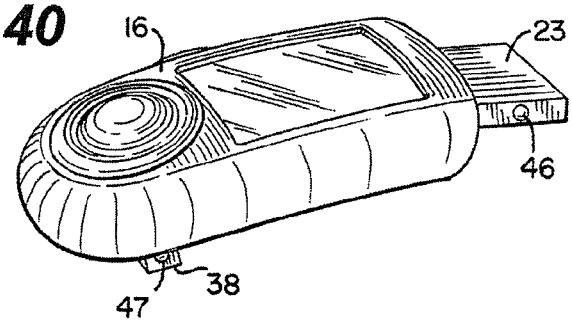
FIG. 41
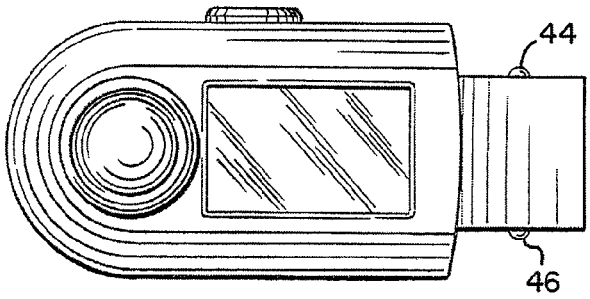
FIG. 43
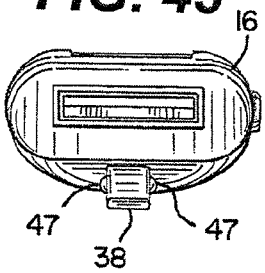
FIG. 42
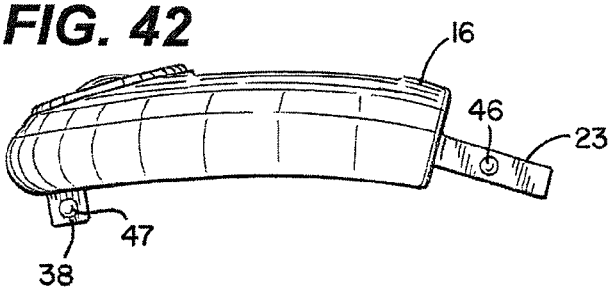
FIG. 44
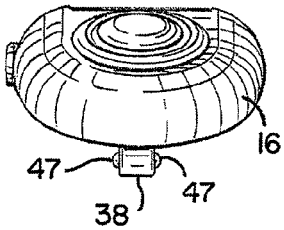
FIG. 45
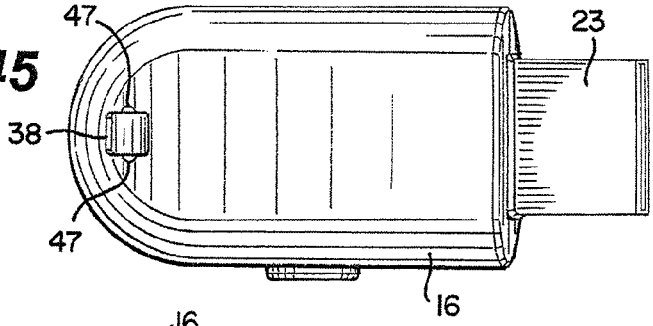
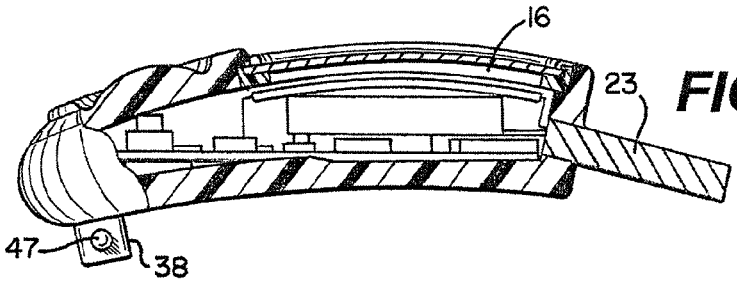
FIG. 46

FIG. 47
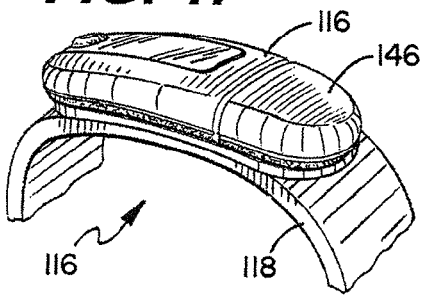
FIG. 48
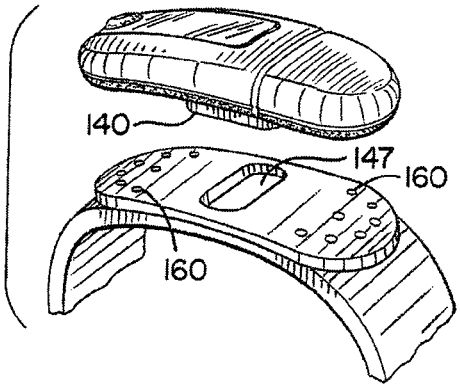
FIG. 49
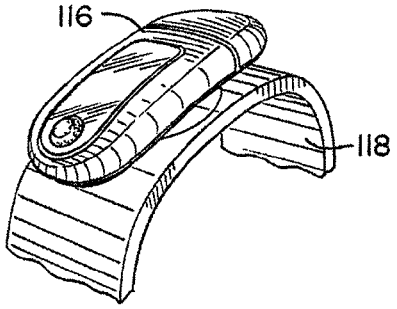
FIG. 50
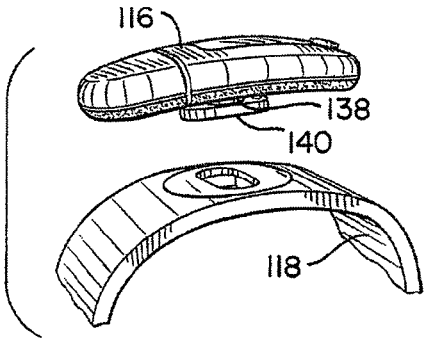
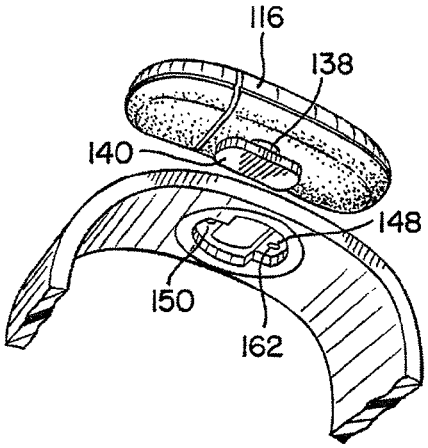
FIG. 51

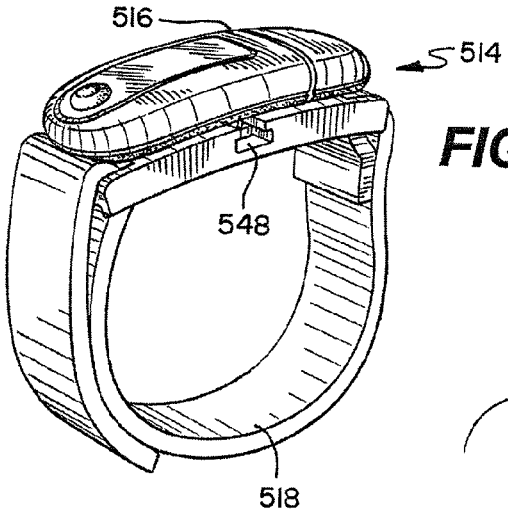
FIG. 61
FIG. 62
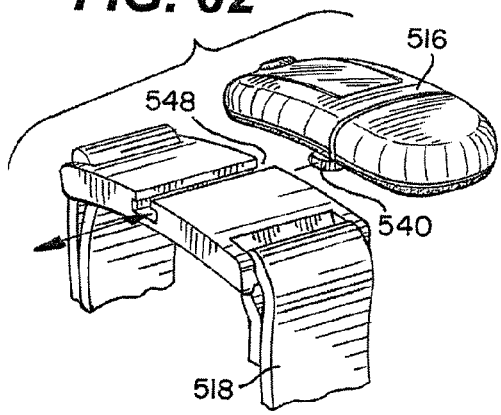
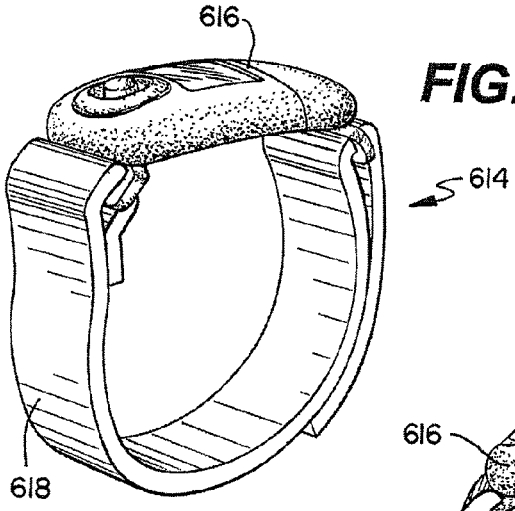
FIG. 63
FIG. 64
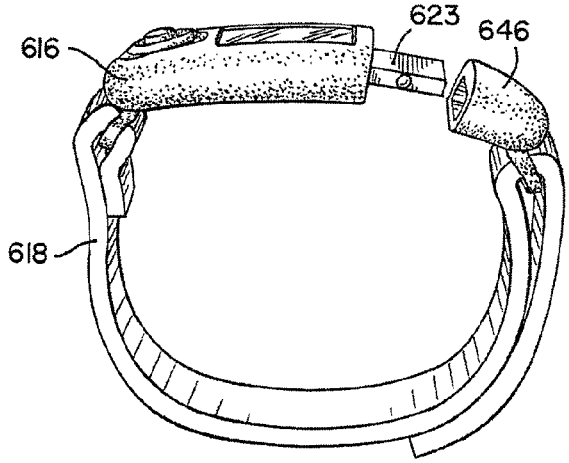

FIG. 68a
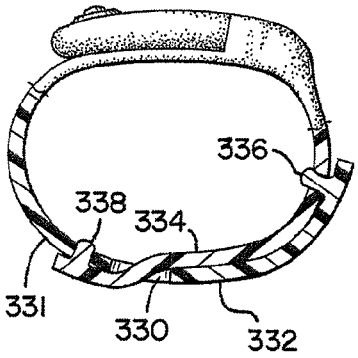
FIG. 68b
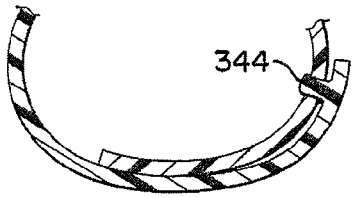
FIG. 68c
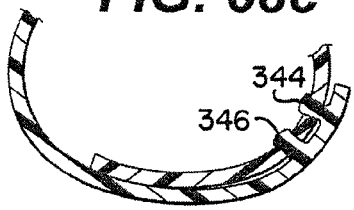
FIG. 68d
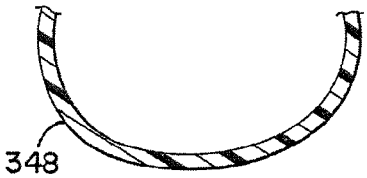
FIG. 68f
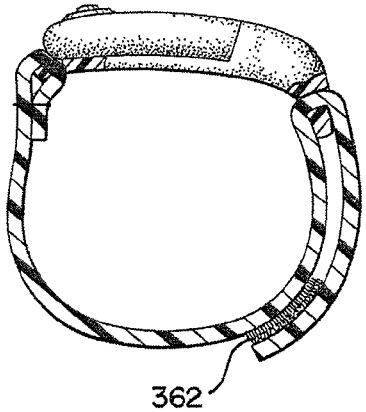
FIG. 68e
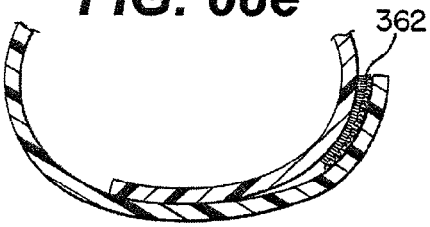
FIG. 68h
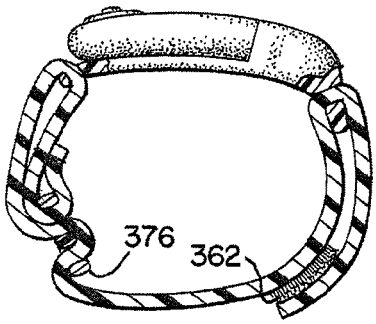
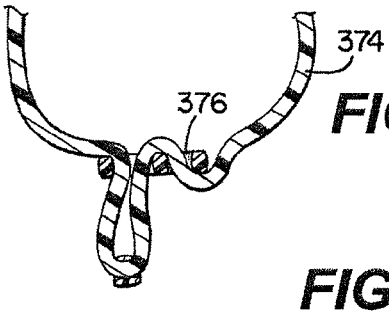
FIG. 68g
FIG. 68i
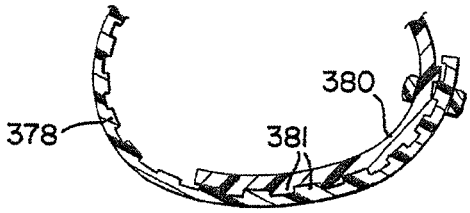

WEARABLE DEVICE ASSEMBLY HAVING ATHLETIC FUNCTIONALITY

RELATED APPLICATION

The present application claims the benefit of and is a continuation of U.S. patent application Ser. No. 12/205,408, filed on Sep. 5, 2008, which is a non-provisional of U.S. Provisional Patent Application No. 60/970,773, filed on Sep. 7, 2007, which application is incorporated by reference herein and made a part hereof.

TECHNICAL FIELD

The invention relates generally to a USB type device, and more particularly, to a wearable USB type device having athletic functionality.

BACKGROUND OF THE INVENTION

Exercise and fitness have become increasingly popular and the benefits from such activities are well known. Various types of technology have been incorporated into fitness and other athletic activities. For example, a wide variety of portable electronic devices are available for use in fitness activity such as MP3 or other audio players, radios, portable televisions, DVD players, or other video playing devices, watches, GPS systems, pedometers, mobile telephones, pagers, beepers, etc. Many fitness enthusiasts or athletes use one or more of these devices when exercising or training to keep them entertained, provide performance data or to keep them in contact with others etc.

Advances in technology have also provided more sophisticated athletic performance monitoring systems. Athletic performance monitoring systems enable easy and convenient monitoring of many physical or physiological characteristics associated with exercise and fitness activity, or other athletic performances including, for example, speed and distance data, altitude data, GPS data, heart rate, pulse rate, blood pressure data, body temperature, etc. This data can be provided to a user through a portable electronic device carried by the user. For example, one athletic performance monitoring system may incorporate an audio player wherein data can be incorporated for display or further communication on the audio player. While athletic performance monitoring systems according to the prior art provide a number of advantageous features, they nevertheless have certain limitations. For example, some users prefer not to use a portable audio player or prefer to obtain and display performance data separately from an audio player. Other athletic performance monitoring systems have limited ability to further upload data to a personal computer or other location for further review and consideration, or such data transfer is cumbersome for the user. The present invention seeks to overcome certain of these limitations and other drawbacks of the prior art, and to provide new features not heretofore available.

A full discussion of the features and advantages of the present invention is deferred to the following detailed description, which proceeds with reference to the accompanying drawings.

SUMMARY OF THE INVENTION

The following presents a general summary of aspects of the invention in order to provide a basic understanding of at least some of its aspects. This summary is not an extensive overview of the invention. It is not intended to identify key or critical elements of the invention or to delineate the scope of the invention. The following summary merely presents some concepts of the invention in a general form as a prelude to the more detailed description provided below.

The present invention provides a USB type device having athletic functionality.

According to one aspect of the invention, a USB device is used as part of an assembly having a carrier wherein the USB device is wearable. In addition, the USB device has a controller that communicates with a sensor to record and monitor athletic performance as an overall athletic performance monitoring system.

According to an aspect of the invention, the USB device is connected to a carrier that in one exemplary embodiment is a wristband. The USB device and wristband have cooperative structure to removably connect the USB device to the wristband. In one exemplary embodiment, the USB device has a protrusion and the wristband has an aperture. The protrusion is inserted into the aperture wherein the USB device is connected to the wristband. It is understood that the protrusion/aperture structures could be reversed on the components.

According to a further aspect of the invention, the wristband has a removable closure. The closure has an indicia-bearing plate having posts that cooperate with openings in the wristband to secure the wristband on a user. The closure is removable wherein different closures bearing different indicia can be utilized with the wristband. The removable closure can also be used with other types of carriers such as heart rate monitor straps used in a heart rate monitor assembly.

According to another aspect of the invention, the USB device has a housing supporting a controller therein. The housing has a structural configuration wherein the housing is water-resistant as well as impact resistant.

According to another aspect of the invention, the controller utilizes a user interface having certain features to enhance the functionality of the device. The USB device has a display wherein performance data can be displayed to the user. The USB device can be plugged into a computer wherein performance data can be automatically uploaded to a remote site for further display and review.

According to a further aspect of the invention, the carrier can take other forms wherein the USB device can be worn by a user in various different locations.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 9 is a bottom plan view of the device shown in FIG. 6;

FIG. 10 is an end view of the device shown in FIG. 6;

FIG. 11 is an opposite end view of the device shown in FIG. 6;

FIG. 12 is a partial cross-sectional view of the device taken along line 12-12 of FIG. 5;

FIG. 28 is a partial cross-sectional view showing an end of the device and carrier;

FIG. 29 is a partial cross-sectional view showing a connector end of the device;

FIG. 30 is another partial cross-sectional view of the device;

FIG. 31 is a partial cross-sectional view of the device showing an input device;

FIG. 40 is a perspective view of a USB device shown in FIG. 37;

FIG. 41 is a top plan view of the device shown in FIG. 40;

FIG. 42 is a side elevation view of the device of FIG. 37;

FIG. 43 is an end view of the device of FIG. 37;

FIG. 44 is an opposite end view of the device of FIG. 37;

FIG. 45 is a bottom plan view of the device of FIG. 37;

FIG. 46 is a partial cross-sectional view of the device of FIG. 37;

FIG. 47 is a partial perspective view of another embodiment of the wearable device assembly;

FIG. 48 is a partial exploded perspective view of the assembly of FIG. 47;

FIG. 49 is a partial perspective view of another embodiment of the wearable device assembly;

FIG. 50 is a partial exploded perspective view of the assembly of FIG. 49;

FIG. 51 is a partial exploded underside view of the assembly of FIG. 49;

FIG. 61 is a perspective view of the another embodiment of the wearable device assembly;

FIG. 62 is a partial exploded perspective view of the assembly of FIG. 61;

FIG. 63 is a perspective view of another embodiment of the wearable device assembly;

FIG. 64 is another perspective view of the assembly of FIG. 63 and shown in a detached configuration;

FIGS. 68*a*-68*i* are partial cross-sectional views showing additional wristband configurations used in the wearable device assembly of the present invention;

DETAILED DESCRIPTION

Figure 1:
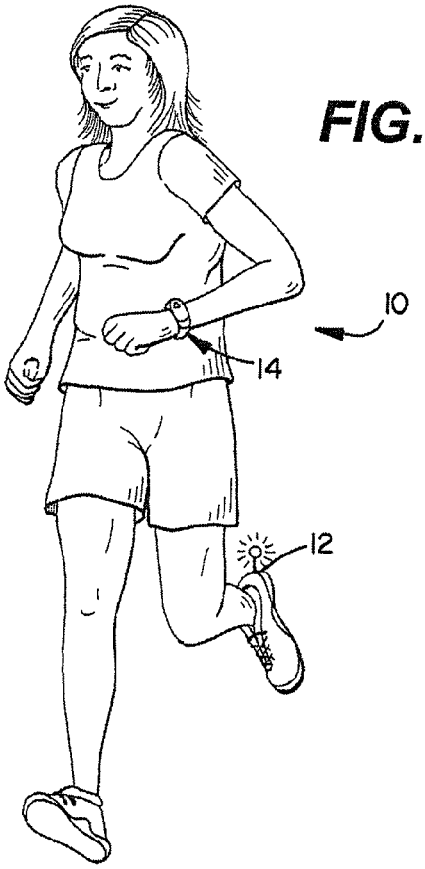
FIG. 1 is a perspective view of a runner wearing a device assembly of the present invention used in an athletic performance monitoring system.

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

General Description of Aspects of the Invention

The present invention provides a USB device having athletic functionality. In one exemplary embodiment, the USB device is as part of an assembly having a carrier wherein the USB device is wearable. In addition, the USB device has a controller that is configured to communicate athletic performance data. The communication may include any or all of one of the following: receiving data, displaying data, transferring data, and recording data. The controller communicates with a sensor to record and monitor athletic performance as an overall athletic performance monitoring system.

The USB device is connected to a carrier that in one exemplary embodiment is a wristband. The USB device and wristband have cooperative structure to removably connect the USB device to the wristband. In one exemplary embodiment, the USB device has a protrusion and the wristband has an opening. The protrusion is inserted into the opening wherein the USB device is connected to the wristband. The wristband has a removable closure. The closure has an indicia-bearing plate having posts that cooperate with openings in the wristband to secure the wristband on a user. The closure is removable wherein different closures bearing different indicia can be utilized with the wristband.

The USB device has a housing supporting the controller therein. The housing has a structural configuration wherein the housing is water-resistant as well as impact resistant.

The controller utilizes a user interface having certain features to enhance the functionality of the device. The USB device has a display wherein performance data can be displayed to the user. The USB device can be plugged into a computer wherein performance data can be automatically uploaded to a remote site for further display and review.

In addition, the carrier can take other forms wherein the USB device can be worn by a user in a various different locations.

Specific Examples of the Invention

While aspects of the invention generally have been described above, the following detailed description, in conjunction with the Figures, provides even more detailed examples of athletic performance monitoring systems and methods in accordance with examples of this invention. Those skilled in the art should understand, of course, that the following description constitutes descriptions of examples of the invention and should not be construed as limiting the invention in any way.

FIG. 1 generally discloses an athletic performance monitoring system 10 that in one exemplary embodiment of the invention includes a wearable device having athletic functionality. As shown in FIG. 1, the athletic performance monitoring system 10 generally includes a module or sensor 12 and a wearable device assembly 14. As discussed in greater detail below, the sensor 12 and wearable device assembly 14 wirelessly communicate with one another to record and monitor athletic performance.

The sensor 12 may have various electronic components including a power supply, magnetic sensor element, microprocessor, memory, transmission system and other suitable electronic devices. The sensor 12 in one exemplary embodiment is mounted on the shoe of a user as shown in FIG. 1. The sensor 12 is used in conjunction with the other components of the system to record speed and distance among other parameters of athletic performance. The sensor 12 can be a sensor as disclosed in U.S. Publication Nos. 2007/0006489; 2007/0011919 and 2007/0021269. These U.S. Publications are incorporated by reference herein and made a part hereof.

The wearable device assembly 14 generally includes a wearable device 16 that in one exemplary embodiment is a USB (Universal Serial Bus) type device 16, and a carrier 18 that in one exemplary embodiment takes the form of a wristband 18. The device 16 has many features similar to a USB flash drive, but has additional functionality as discussed in greater detail below. In addition, the device 16 is removably connected to the wristband 18.

As depicted in FIGS. 6-12, the wearable device 16 generally includes a housing 20 and a controller 21 that is contained by the housing 20. General components and functional capabilities of the controller 21 will be described in greater detail below. The housing 20 has a first end 22, a second end 24, a first side 26, a second side 28, a front side 30, and a back side 32.

As further shown in FIGS. 6-12, the first end 22 includes a connector 23 that is generally a standard USB connector having leads 81 or contacts embedded therein. The connector 23 is integrally molded with the housing 20 as described in greater detail below. The connector 23 is adapted to connect to a USB hub of a computer. The front side 30 has a pushbutton 33 that will cooperate with a first input 32 of the controller 21 for controlling the wearable device 16 as described in greater detail below. The first side 26 includes a side opening for accommodating second pushbutton 37 that cooperates with a second input 34 of the controller 21 for controlling the wearable device 16. The front side 30 also accommodates a display 36 of the controller 21. It is understood that the front side 30 of the housing 20 could have an opening wherein a screen of the display is positioned therein. It is also understood that the housing 20 could be formed such that it has a solid, thin layer wherein the display 36 of the controller 21 is viewable through the thin layer on the front side 30.

As depicted in FIGS. 6-12, the back side 31 of the housing 20, near the second end 24, has a protrusion 38. The protrusion 38 has a generally circular cross-section. The protrusion 38 has an enlarged rounded head and an insert that fits within the interior of the housing 20 (FIG. 12). As explained in greater detail below, the protrusion 38 is adapted to be inserted into a receiver or aperture 40 in the carrier 18. As further shown in FIG. 7, the device 16 has an overall curvature that provides an enhanced fit for a user wearing the device on the wrist. The curvature provides the connector 23 extending in a downward direction.

As further shown in FIGS. 6-12, the components of the controller 21 are contained within and supported by the housing 20. The controller 21 includes various electrical components allowing the controller 21 and device 16 to act as an interface device wherein the device 16 can communicate with the sensor 12, record and store data relating to athletic performance, other time information, as well as upload performance data to a remote location or site as described in greater detail below. The controller 21 further includes the first input 32 and the second input 34. The controller 21 further includes the display 36 that is positioned on the front side 30 of the housing 20. It is further understood that the controller 21 is operably connected to the connector 23 of the housing 20.

Figure 2:
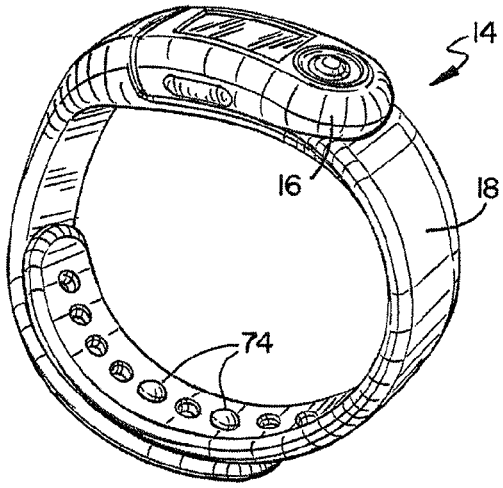
FIG. 2 is a perspective view of the wearable device assembly shown in FIG. 1.
Figure 3:
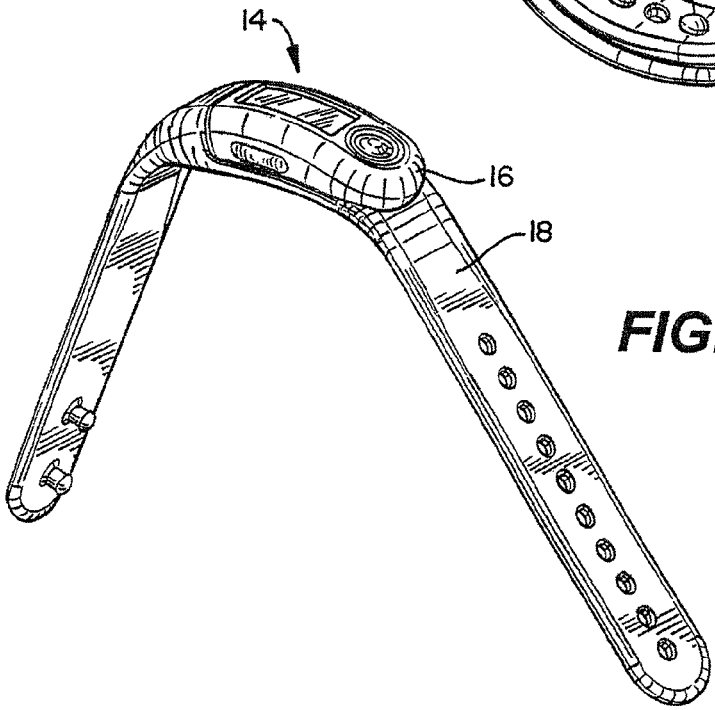
FIG. 3 is a perspective view of the wearable device assembly shown in FIG. 1, with a wristband of the device in an unfastened position.
Figures 13, 14, 15, 16:
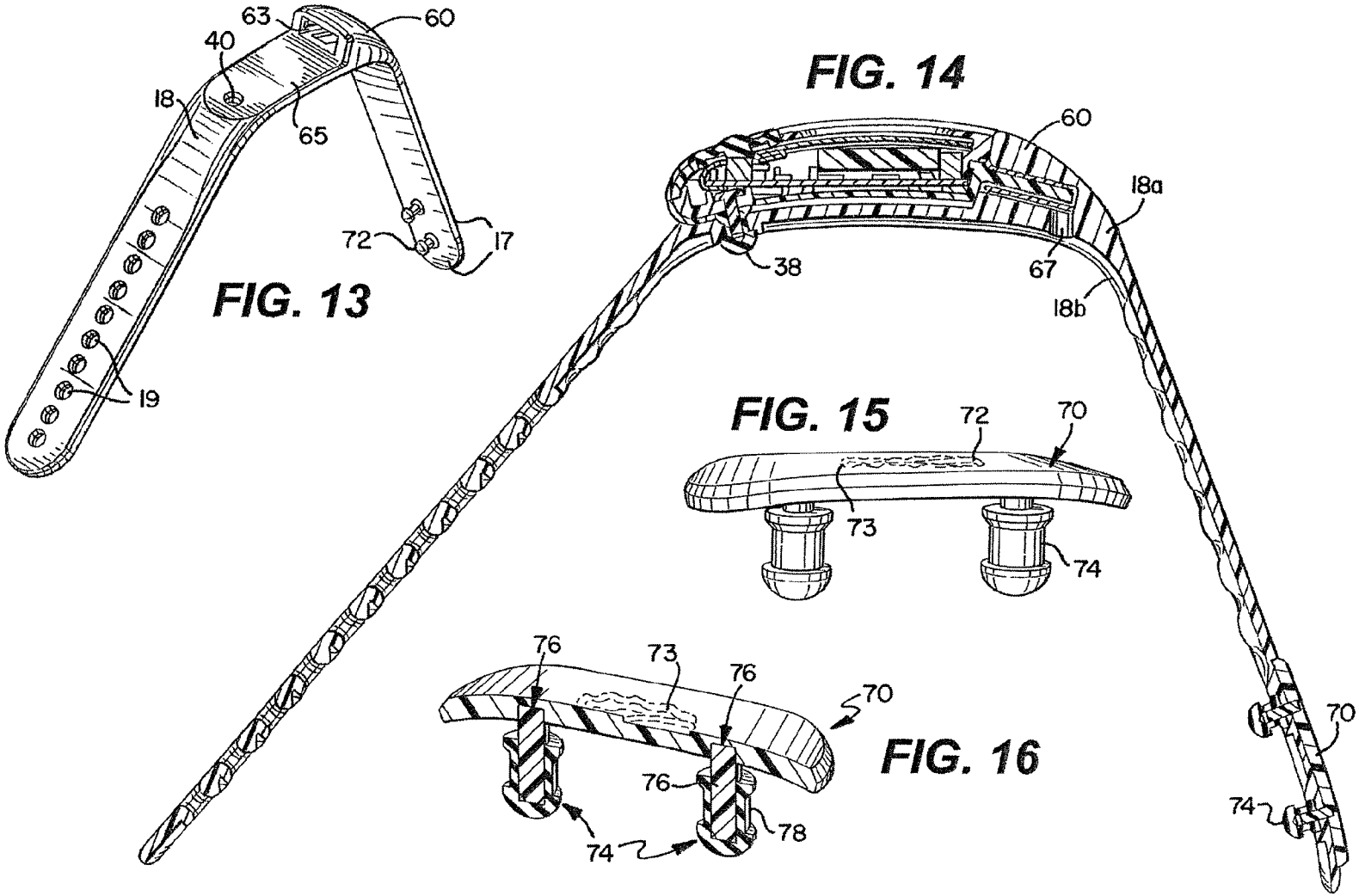
FIG. 13 is a perspective view of the carrier or wristband of the device assembly of FIG. 3 and having the device of FIG. 6 removed.
FIG. 14 is a cross-sectional view of the device assembly of FIG. 3.
FIG. 15 is a perspective view of a removable closure used with the wristband.
FIG. 16 is a schematic cross-sectional view of the removable closure shown in FIG. 15.
Figure 17:
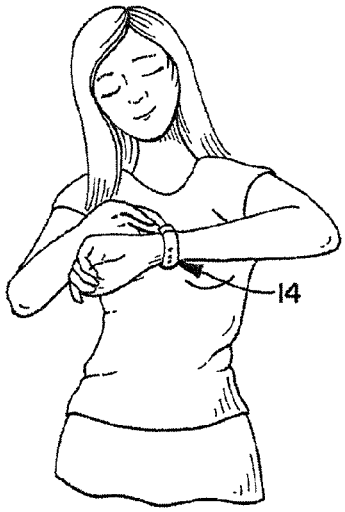
FIG. 17 is a partial perspective view of a runner setting the device.

As shown in FIGS. 2-4 and 12-14, the carrier 18 is generally in the form of a wristband 18 having a central portion between a first end portion and a second end portion. The wristband 18 may include a first member 18*a* and second member 18*b* generally molded or connected together. The wristband 18 is flexible to fit around a user's wrist. In one exemplary embodiment, the wristband 18 may be injected molded of a flexible polymeric material. The wristband 18 has receiving structures for connection to the device 16. The carrier 18 includes a protective sleeve 60 proximate the central portion and having an opening 61 for receiving the connector 23 of the housing 20. The protective sleeve 60 has a generally contoured surface. As shown in FIG. 13, the sleeve 60 may have internal structure for assisting in securing the connector 23, such as ridges 63 that provide an interference type fit between the sleeve 60 and the connector 23. A recess 65 is also defined between the ridges 63 providing a gap between the connector 23 and a bottom portion of the sleeve 60. A vent 67 is provided through a bottom portion of the wristband 18 and is in communication with recess 65 proximate the connector 23 when inserted into the wristband 18. The vent 67 allows any moisture to escape from the wristband 18 and be channeled away from the connector 23. Also at the central portion, the carrier 18 has an aperture 40 dimensioned to receive the protrusion 38 of the wearable device 16. As further shown in FIGS. 3 and 4, the first end portion has a pair of holes 17 to accommodate a removable closure as described in greater detail below. The first end portion has a recessed area 71 (FIG. 14). The second end portion has a plurality of holes 19 to cooperate with the removable closure as further described below for securing the wristband 18 to a wrist of a user (FIG. 2).

As further shown in FIGS. 4 and 13-16, the wristband 18 has a removable closure 70 used to fasten the wristband 18 to a wrist of a user. To this end, the removable closure 70 cooperates with the plurality of holes in the wristband 18. The removable closure 70 has a plate member 72 and a plurality of posts 74 extending generally in a perpendicular direction from the plate member 72. In the exemplary embodiment depicted in FIG. 15, the plate member 72 has two posts 74. Each post 74 has an insert 76 that is pressed on or snap-fitted onto the post 74. Each insert 76 is spot welded to the plate member 72. Each insert 76 may be rounded in order to provide a comfortable fit against a user's wrist. Other connection methods are possible. A gap is maintained between an inside surface of the plate member 72 and a bottom surface of the post 74. In addition, each post 74 has an annular channel 78 around a periphery of the post 74.

To wear the wristband, first the removable closure 70 is connected to the first end portion of the wristband strap 18 wherein the pair of holes 17 is provided to receive the posts 74. The wristband 18 fills the gap. It is further understood that the recessed area 71 in the wristband 18 is dimensioned according to the size of the plate member 72 wherein the plate member 72 fits snugly within the recessed area 71. The wristband 18 is positioned around the user's wrist and the posts 74 are inserted into the holes 19 provided on the second end portion of the wristband 18 as can be appreciated from FIG. 2. The portion of the wristband 18 proximate the holes 19 fits within the annular channels 78 of the posts 74. After the posts 74 are inserted into the pair of holes 17 of the first end portion of the wristband 18 and the plurality of holes 19 of the second end portion of the wristband 18, the first end portion and second end portion of the wristband overlap one another. With the use of a pair of posts 74, the removable closure 70 allows for a secure connection and greater flexibility in connection providing for a greater adjustment to accommodate for a range of wrist sizes.

Additionally, the plate member 72 can have indicia 73 thereon. The plate member 72, when attached to the wristband 18 faces away from the wristband 18 wherein the indicia 73 can be viewed by others. Because the removable closure 70 is easily removable, the closure 70 can be used as a memento, different closures can be provided and used with the wristband 18. Thus, removable closures 70 having different indicia can be provided and used as a keepsake, memento, or a reward for accomplishing a goal, participating in a race, or otherwise achieving a certain level of fitness. Indicia can take various forms including wording, graphics, color schemes, textures, or other designs etc.

As discussed, the wearable device 16 is removably connected to the carrier 18. The connector 23 is inserted into the sleeve 60 of the carrier 18, and the protrusion 38 is placed into the aperture 40 of the carrier 18. The protrusion 38 may extend perpendicularly from the central portion of the carrier 18. The enlarged head of the protrusion abuts against the wristband 18 to retain the device 16 onto the wristband 18. This provides for a wearable device 16 that can be disconnected from the carrier 18 when desired and plugged into a computer as discussed in greater detail below. It is understood that detent structures can be provided between the connector 23 and sleeve 60 of the various different embodiments disclosed herein.

It is understood that the device 16 has general functions such as keeping the time of day just like a conventional watch device. It is further understood, however, that the device 16 has athletic functionality and can be used as part of the athletic performance monitoring system 10. For example, a user wearing shoes having the sensor 12 mounted therein can use the device 16 to wirelessly communicate with the sensor 12 and monitor performance such as for running.

Figure 18:
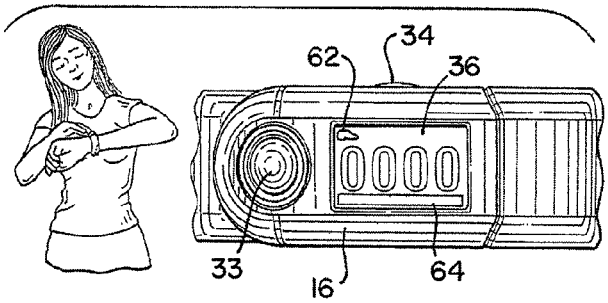
FIG. 18 is a schematic view of the runner setting the device and a plan view of the device indicating that the device is ready to start.
Figure 19:
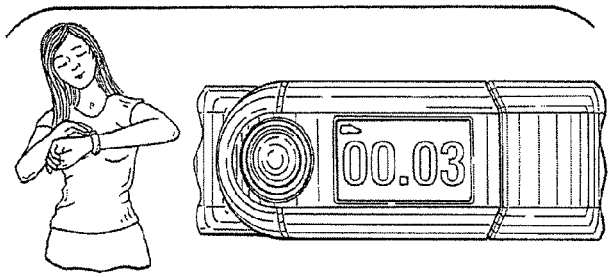
FIG. 19 is a schematic view of the runner starting the device and a plan view of the device indicating time elapsed.
Figure 20:
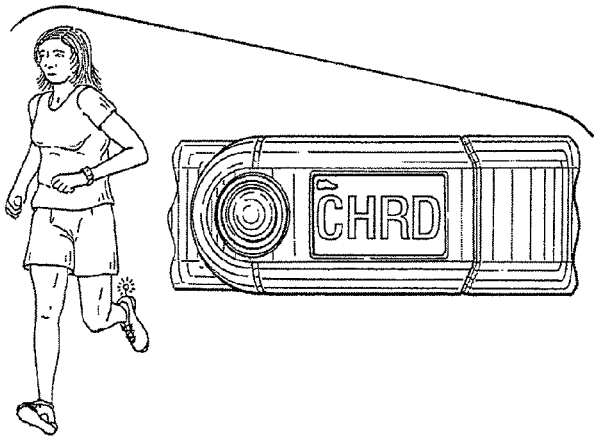
FIG. 20 is a schematic view of the runner and plan view of the device indicating the device is in a data recording mode.
Figure 21:
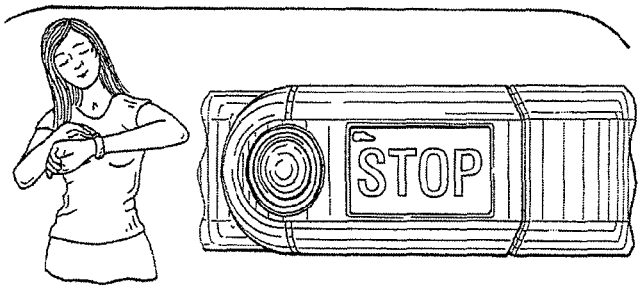
FIG. 21 is a schematic view of the runner stopping the device and a plan view of the device indicating that the device has been stopped.
Figure 22:
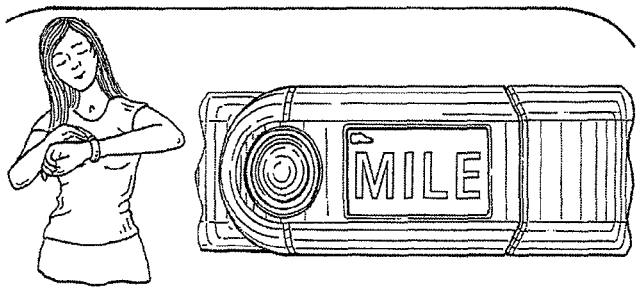
FIG. 22 is a schematic view of the runner reviewing performance data and a plan view of the device preparing to indicate miles run.
Figure 23:
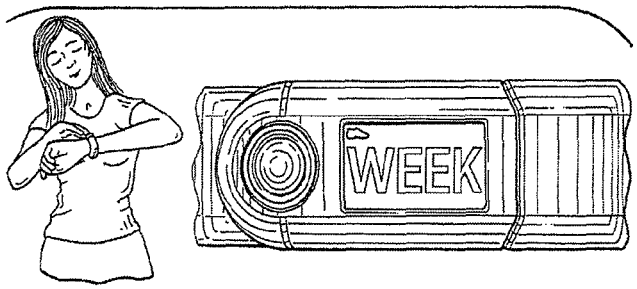
FIG. 23 is a schematic view of the runner reviewing performance data and a plan view of the device preparing to indicate miles run in a week.
Figure 24:
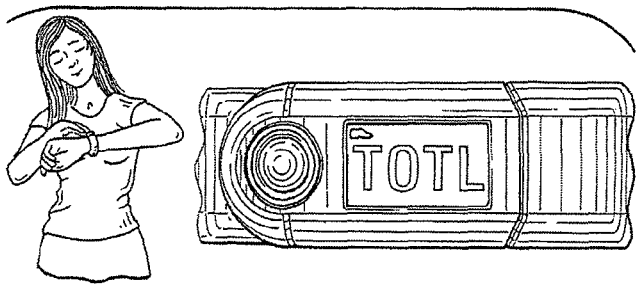
FIG. 24 is a schematic view of the runner reviewing performance data and a plan view of the device preparing to indicate total miles run.
Figure 25:
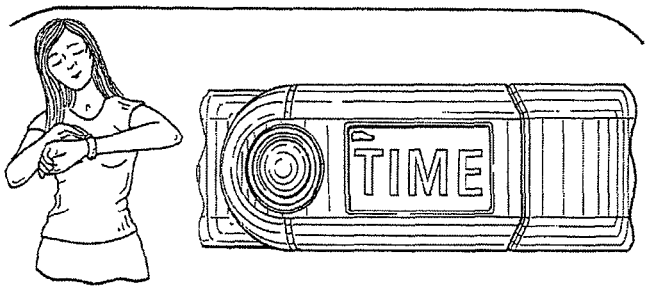
FIG. 25 is a schematic view of the runner reviewing performance data and a plan view of the device preparing to indicate time.

As can be appreciated from FIGS. 17-27, when the user wants to start a run, the user must first allow the sensor 12 to communicate with the wearable device 16. It is understood that the device 16 may first be calibrated for the user. To start a run, the user pushes and holds the first input 32 via the pushbutton 33 on the front side 30 of the housing 20. While the user holds the first input 32, the display 36 exhibits scrolling zeros as the wearable device 16 searches for the sensor 12. Once the sensor 12 is located, as shown in FIG. 18, the display 36 indicates that the wearable device 16 is ready to start by displaying a shoe symbol 62 in the upper left corner and a blinking underline 64. The user then pushes the first input 32 again to initiate the recording of the run. The wearable device 16 then records various information during the run such as elapsed time as shown in FIGS. 19 and 20. A bottom line on the display 36 animates back and forth to indicate that the device 16 is in the record mode. During the run, the user can toggle through the distance ran, current pace, elapsed time, and calories spent by pushing the second input 34 via second pushbutton 37. To stop recording, the user pushes the first input 32. After the device 16 is stopped, the user can review the last distance run (FIG. 22), average pace, calories burnt, average calories burnt per minute, miles ran per week (FIG. 23), total miles (FIG. 24), and the time of day of the run (FIG. 25) by pressing the second input 34, which toggles through these values.

Figure 26:
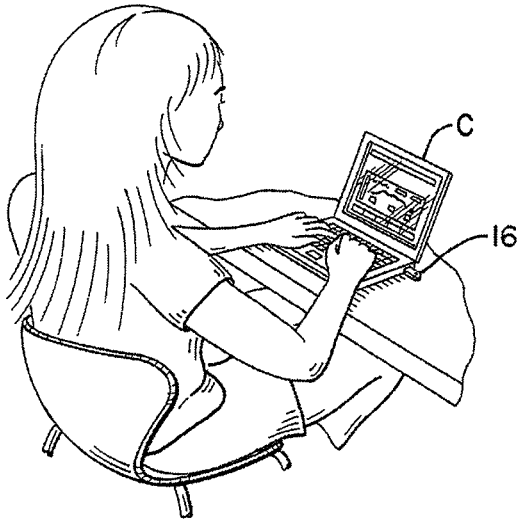
FIG. 26 is a perspective view of the runner at a computer and having the device plugged into the computer.
Figure 27:
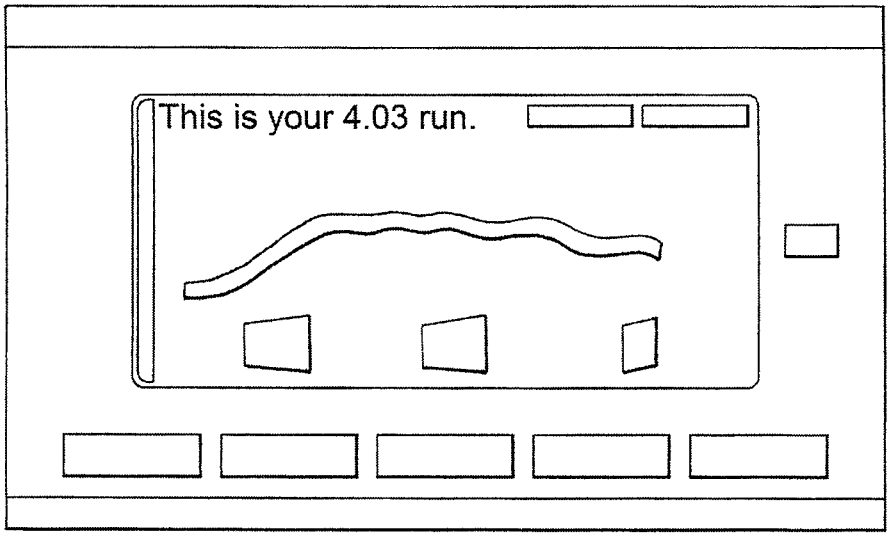
FIG. 27 is a front view of a computer screen displaying performance data recorded by the device.
Figure 32:
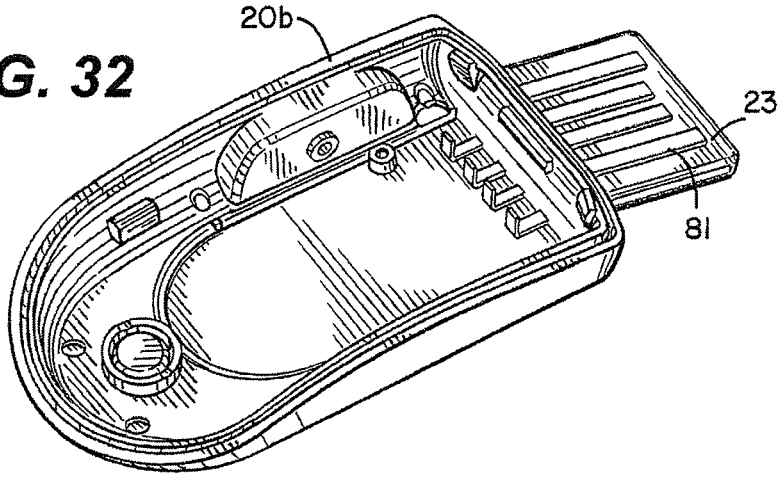
FIG. 32 is a perspective view of a bottom member of a housing of the device shown in FIG. 6.
Figure 33:
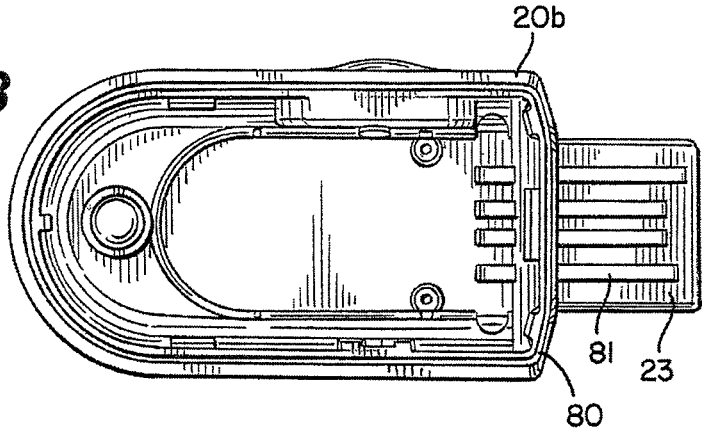
FIG. 33 is a plan view of the bottom member of the housing shown in FIG. 32.
Figure 34:
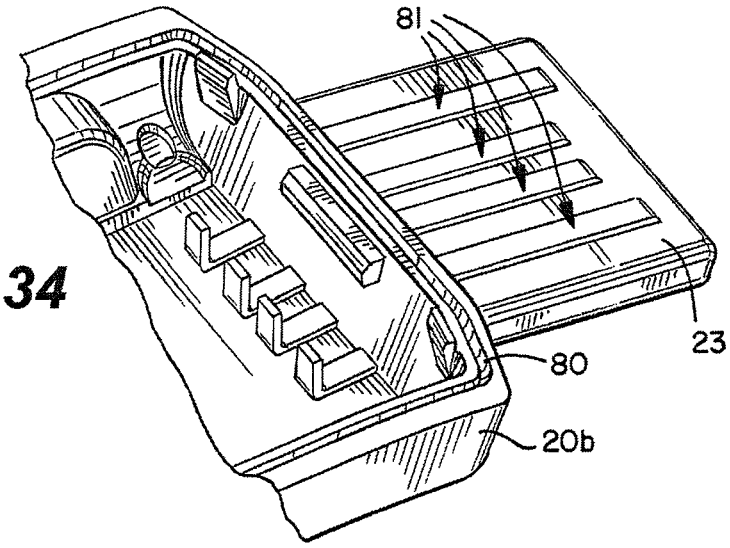
FIG. 34 is a partial perspective view of the bottom member of the housing shown in FIG. 32.
Figure 35:
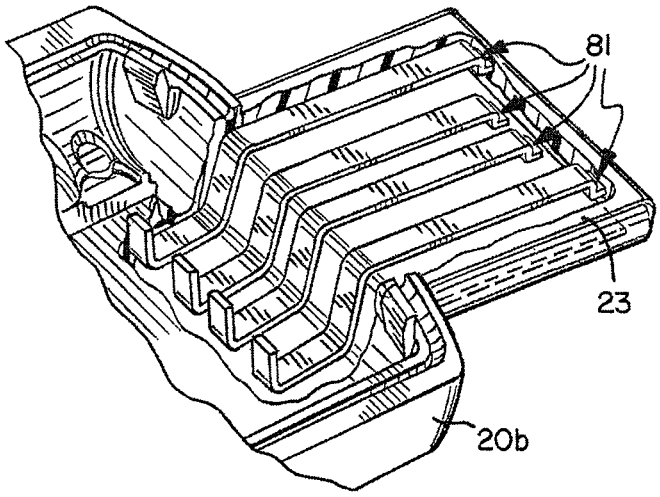
FIG. 35 is partial perspective view of the bottom member of the housing with a portion shown in phantom lines.

The device 16 has additional capability for uploading of the recorded data to other remote locations such as locally on a personal computer or a remote website for further display, review and monitoring. To this end, it is understood that the controller 21 of the device has an appropriate user interface wherein a user can download appropriate software via a computer from a remote location. The device 16 is removed from the carrier 18 wherein the protrusion 38 is removed from the aperture 40 and the connector 23 is removed from the sleeve 60. As shown in FIGS. 26 and 27, the connector 23 is then plugged into the standard USB hub/port on a computer C. Once the appropriate software is installed, the application will commence with device 16 still being plugged into the computer. The software application may prompt the user through a device set-up procedure (time, calibration etc.). At this point, if desired, the user can upload the performance data from the run to a remote website location such as one dedicated to monitoring athletic performance. The user can log onto the particular website via a standard web-browser and upload the performance data from the device 16 to the website. As shown in FIG. 27, the user can then review data relating to the run. The website may display the data in graphical form. Other features can also be provided to assist the user in utilizing the data recorded by the device. Additional registration features can be provided with the website wherein additional features can be provided to the user for use with the device 16.

The user interface associated with the controller 21 of the device 16 can provide additional functionality to the user. The software can include a self launching feature, which automatically launches the software once the wearable device 16 is connected to a computer containing the software. Once the program is launched, the software will also automatically download the data from the device 16 to the computer and transfer the data to a web server and to the website discussed above. The software can also detect the device class connected to the port and configure the correct application for that specific device. For example, there may be wearable devices 16 having different configurations, or technical capabilities, and thus may be classified differently. The software can change the feature set of the fitness activity recording of the wearable device 16 connected to the port of the computer. After the wearable device 16 is disconnected from the computer, the software automatically exits. The user interface may also be configured to allow a user to selectively activate and de-activate features according to the preferences of the user. The user may also be able to modify software associated with the device.

The software has an extremely simple calibration method and user interface. For example, it is very simple to calibrate distance measurements onto the device. The software can also track motivational information among several classes of fitness activity recording devices. For example, the user can set weekly goals and the software can track the user's progress with these goals. The user can also use multiple devices, such as an audio player having a suitable interface device, other types of sport watches etc., along with the device of the present invention, and the software will accumulate the weekly and overall total distance recorded by all of the devices. Thus, the data is kept synchronized over multiple devices.

The website can additionally have a guest log in, which allows the user to upload data automatically from the device without requiring the user to register. This feature allows the user to use the website without giving personal information. Later, if the user decides to register the device, a unique PIN number associated with each wearable device is matched up with registration information automatically.

As discussed, the wearable device assembly 14 utilizes its housing 20 to support the controller 21 and associated components. In one exemplary embodiment, the housing 20 has unique structures to enhance its functionality. Because the device 16 is used in fitness activities, there is some chance that the device 16 can be subject to water or moisture such as perspiration. The housing 20 is designed to be water-resistant to protect components of the controller 21. Such structures further provide for a certain level of impact resistance.

As shown in FIGS. 28-36, the housing 20 has a first member 20*a* and a second member 20*b*. The first member 20*a* is joined with the second member 20*b* to form the housing 20. The members 20*a*, 20*b* are generally formed from plastic in an injection molding process. It is understood that the housing 20 can be constructed from other suitable materials.

As discussed, the front side 30 of the housing 20 has a first push button 33 that is flexible and cooperates with the first input 34 of the controller 21. In an exemplary embodiment, the first push button 33 is co-molded with the first member 20*a*. The co-molding process allows for the combination of a hard plastic portion with a soft elastic polymer portion. The hard polymer portion provides the controller 21 with adequate protection from shock or other forces, and the soft elastic polymer portion of the push button 33 allows the user to depress the first push button 33 to actuate the first input 32. With the co-molding process, the first push button 33 is integral with the housing 20. Together the hard polymer portion and the soft elastic polymer portion provide for an adequate sealed structure of the housing 20 around the first push button 33 of the housing 20.

Figure 36:
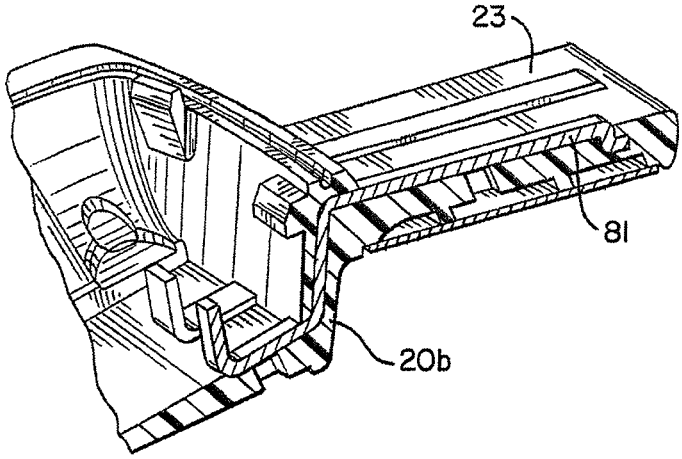
FIG. 36 is a partial cross-sectional view of the bottom member of the housing shown in FIG. 32.
Figure 37:
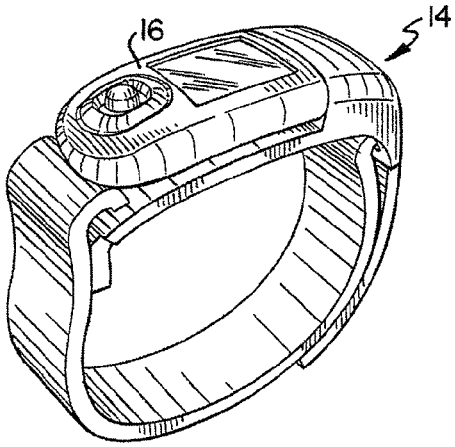
FIG. 37 is a perspective view of another embodiment of the wearable device assembly of the present invention.
Figure 38:
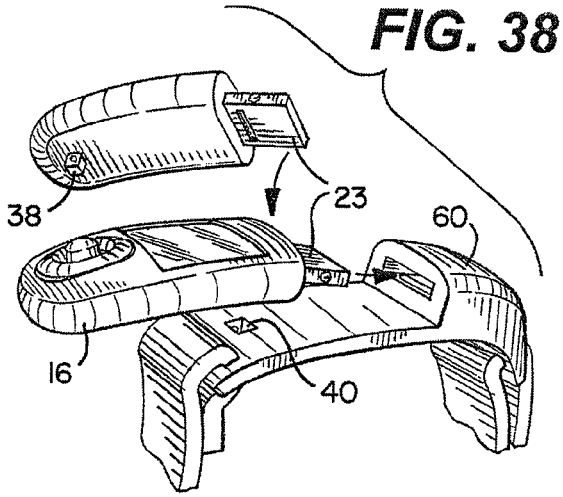
FIG. 38 is an exploded perspective view at a first angle of the wearable device assembly shown in FIG. 37.

As depicted in FIGS. 32-36, the second member 20*b* of the housing 20 is formed in an injection molding process having the connector 23 and a U-shaped groove 80. The connector 20 has a plurality of leads or contacts 81 associated therewith making up the USB connection. The connector 23 is integrally molded with the remaining portions of the second member 20*b* to eliminate the need for a separate connection and seal around the connector 23. Thus, the leads 81 are embedded in the plastic material defining the connector 23 (FIG. 36). The leads 81 can have break-off portions to assist in the molding process. As further shown in FIGS. 27-36, the U-shaped groove 80 is molded into the second member 20*b* and extends around the full periphery of the second member 20*b*. The second member 20*b* also includes locating ribs for assisting in providing an accurate fit between the first member 20*a* and the second member 20*b*. As further shown in FIG. 32, the second member 20*b* has an internal shroud to accommodate the structure associated with the second input 34 as described in greater detail below. The second member 20*b* further has a hole for accommodating and supporting the protrusion 38 (FIG. 12).

To join the first member 20*a* and the second member 20*b*, the necessary components of the controller 21 are suitably mounted in and connected to the second member 20*b*. The U-shaped groove 80 is filled with an epoxy 84 (shown schematically in FIG. 28). A flexible epoxy suitable for bonding injection molded parts is used. The first member 20*a* is then placed onto the second member 20*b* using the locating ribs and the epoxy bead 84 is allowed to set. Once the epoxy 84 sets, a flexible and water resistant seal is formed between the first member 20*a* and the second member 20*b*.

As further shown in FIG. 31, the second input 32 has a second push button 37 associated therewith. The second push button 37 has an actuator post 39 extending therefrom and through the side opening of the housing 20. It is understood that the first member 20*a* and second member 20*b* of the housing 20 are molded to define the side opening. The side opening narrows down to a post opening 41 adjacent an interior of the housing 20 for communication with further components of the second input 34. The actuator post 39 has an annular groove 43 around a periphery of the post 39. Additionally, a sealing member such as an o-ring 88 surrounds the actuator post 39 in the annular groove 43. The o-ring 88 is sized to seal against the interior surface defined by the post opening 41. The o-ring 88 provides an adequate seal such that debris, water or other moisture cannot enter the housing 20 through the side opening in the housing 20.

This overall arrangement provides for a robust wearable device. The wearable device housing structure can absorb the shocks and impacts of running such that the controller can operate smoothly. Additionally, the wearable device housing structure prevents debris, water, perspiration or other moisture from ingress into the interior of the housing where it could contaminate the controller 21 and adversely affect operability. In one exemplary embodiment, the wearable device 16 is water-resistant to approximately five atmospheres of pressure.

FIGS. 37-46 disclose another embodiment of the wearable device assembly of the present invention. This wearable device assembly is similar to the wearable device shown in FIGS. 2-16 and similar reference numerals may be used to refer to similar components. Difference in this design will be discussed further.

The USB device 16 is removably connected to the wristband 18 in similar fashion with the connector 23 insertable into the sleeve 60 and the protrusion 38 insertable into the aperture 40 in the wristband 18. In this embodiment, the connector 23 may have a first protuberance 44 and a second protuberance 46 thereon. The protuberance 44, 46 fit into small recesses 49 located within the sleeve 60. This arrangement provides for an audible click-in sound or tactile feel indicating that the device 16 is fully inserted into the sleeve 60. The protrusion 48 has a generally square cross-section and has detents 47 thereon extending outwardly in the direction of the first side and the second side of the wearable device 16 respectively. The detents 47 cooperate with recesses in the structure defining the aperture 40 to provide a tactile feel and additional interference fit characteristics.

Figure 39:
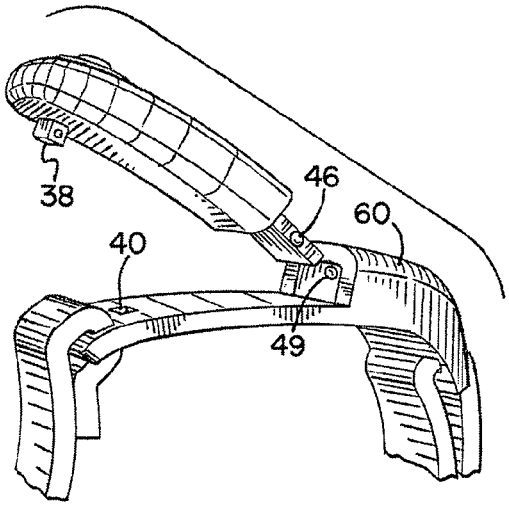
FIG. 39 is another exploded perspective view at a second angle of the wearable device assembly shown in FIG. 37.
Figure 39A:
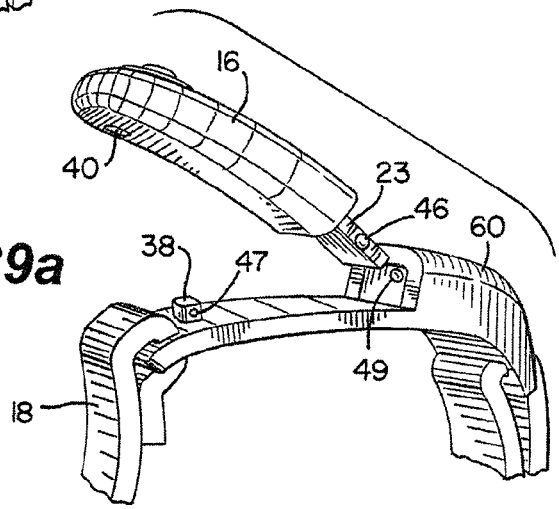
FIG. 39*a* is an exploded perspective view of an alternative embodiment of the wearable device shown in FIG. 39.

The wristband 18 in this embodiment also has slightly different structure. The central portion has a first receiving portion and a second receiving portion. A first end of a strap is passed through the first receiving portion and fastened to itself in a loop configuration. A second end of the strap is passed through the second receiving portion and folded onto itself The strap may be provided with hook and loop fasteners on appropriate sides of the strap providing suitable structure for fastening the strap around a wrist of a user. As previously discussed, the protrusion/aperture structure on the device 16 and wristband 18 can be reversed if desired such as shown in FIG. 39*a* wherein the protrusion 38 is located on the wristband 18 and the aperture 40 is located on the device 16. Thus, the male/female cooperative structure between the device 16 and the wristband 18 can be reversed if desired. This interchangeability of the male/female cooperative structure also applies to the other embodiments of the application. The functionality of the wearable device assembly in FIGS. 37-46 is the same as previously described with respect to the wearable device assembly of FIGS. 2-16.

FIGS. 47-71 disclose various alternative embodiments of the wearable device assembly of the present invention. The embodiments generally utilize a USB type device and a carrier. Similar reference numerals in sequential series may be used and additional features will be discussed below. The functionality of the USB device of the various embodiments is generally the same as discussed above and can be used in the athletic performance monitoring system 10.

In other embodiments depicted in FIGS. 47-51, the wearable device 116 has a flange portion 140 extending from a connecting mid-portion 138 for connecting the flange portion 140 to the carrier 118. The flange portion 140 extends from the device 116 via the mid-portion 138 wherein a gap maintained between a bottom portion of the device 116 and the flange portion 140. The device 116 includes a removable cap 146 for protecting the connector from the elements. The carrier 118 is in the form of a wristband and has an elongated slot 147 at the central portion. The face of the carrier 118 can have guide holes 160 to provide for a tactile feel. The elongated slot 147 receives the flange portion 140 of the device 116. As depicted in FIG. 51, an underside of the carrier 118 has a first locking groove 148 and a second locking groove 150. The first locking groove 148 and the second locking groove 150 can include locating holes 162 to provide for a tactile feel with associated structure on the flange portion 140. The grooves 148, 150 receive the flange portion 140.

To secure the device 116 to the carrier 118, the flange portion 140 is aligned with the elongated slot 147 located in the carrier 118. Once the flange portion 140 is aligned with the elongated slot 147, the flange portion 140 is inserted through the slot 147. The user then rotates the wearable device 116 one hundred eighty degrees such that the first end and the second end of the flange portion 140 align with the first locking groove 148 and the second locking groove 150 respectively. Thus, the device 116 is mounted such as shown in FIG. 47. Additionally, the locating protrusions align with the locating holes 162 so the user knows that the device 116 is properly secured to the carrier 118. Thus, the device 116 is connectable and removable from the carrier 118 using a rotational movement.

Figure 52:
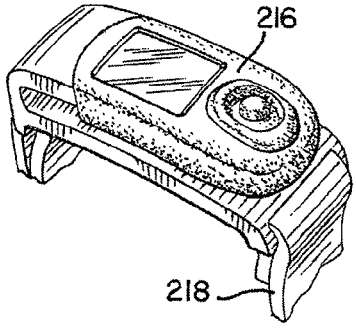
FIG. 52 is a partial perspective view of another embodiment of the wearable device assembly.
Figure 53:
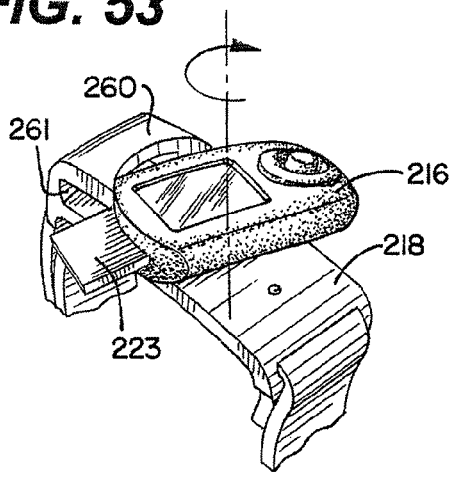
FIG. 53 is a partial perspective view of the assembly of FIG. 52 and showing the device rotated.
Figure 54:
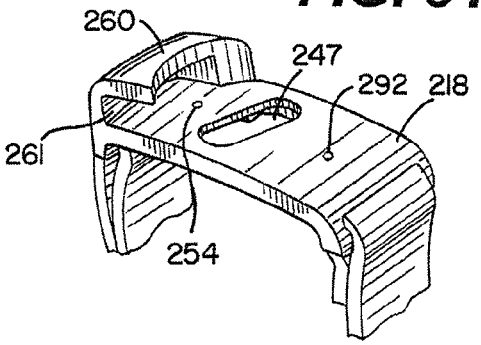
FIG. 54 is a partial perspective view of the wristband of the assembly of FIG. 52.

In another embodiment shown in FIGS. 52-54, the carrier 218 has a sleeve 260 for protecting the connector 223 of the device 216 from the elements. The sleeve 260 is provided with an open face 261, such that when the wearable device 216 is connected to the carrier 218, the connector 223 can pass through the open face 261 into the sleeve 260. Additionally the carrier 218 is provided with a first hole 252 and a second hole 254, and the wearable device 216 is provided with a corresponding first protrusion (not shown) and second protrusion (not shown) to provide for a tactile feel. The wearable device 216 connects to the carrier 218 via a slot 247. The slot 247 has similar structure and function to the slot disclosed in the embodiment disclosed in FIGS. 47-51. In this embodiment, the slot 247 is slightly offset on the carrier 218. The wearable device 216 connects to the carrier 218 in a similar fashion as the embodiment disclosed in FIGS. 47-51, thus using a rotational movement. The flange portion on the device 216 is aligned with the offset slot 247 wherein the device 216 is then rotated wherein the connector 223 is positioned into the sleeve 260 through the open face 261.

Figure 55:
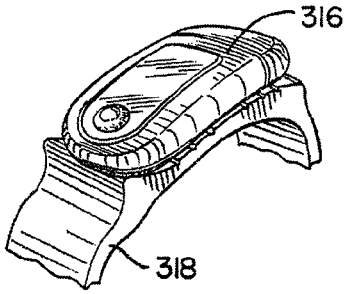
FIG. 55 is a partial perspective view of another embodiment of the wearable device assembly.
Figure 56:
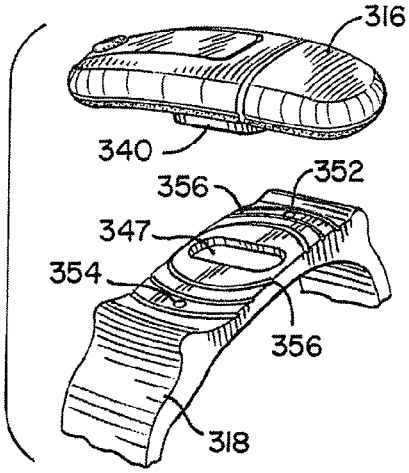
FIG. 56 is a partial exploded perspective view of the assembly of FIG. 55.

In the embodiment depicted in FIGS. 55 and 56, the carrier 318 can be formed with grooves 356. The device 316 can be provided with corresponding groove followers (not shown). The grooves 356 and the groove followers provide for a tactile feel as the wearable device 316 is connected to the carrier 318. The carrier 318 can also be provided with a first locating hole 352 and a second locating hole 354. The wearable device 316 can be provided with a corresponding first protrusion (not shown) and second protrusion (not shown). The locating holes 352, 354 and the protrusions (not shown) also provide for a tactile feel as the wearable device 316 is connected to the carrier 318. The carrier 318 has a slot 347 to receive a flange 340 on the device 316. Similar to the embodiments above, a rotational movement is utilized to connect and remove the device from the carrier 318.

Figure 57:
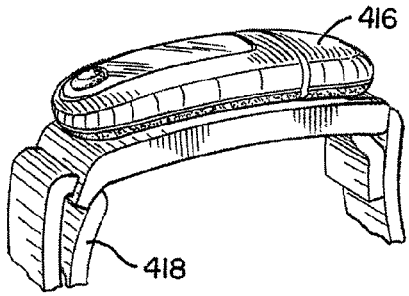
FIG. 57 is a partial perspective view of another embodiment of the wearable device assembly.
Figure 58:
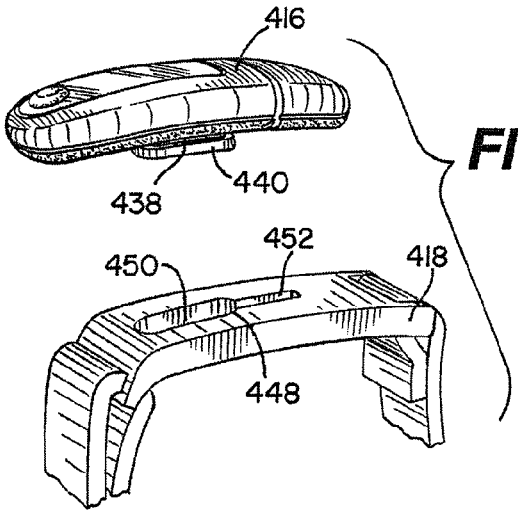
FIG. 58 is a partial exploded partial perspective view of the assembly of FIG. 57.

In another embodiment depicted in FIGS. 57 and 58, the carrier 418 is formed with an opening 448 having a wide portion 450 and a narrow portion 452. The wide portion 450 is dimensioned such that the flange 440 can be fully inserted into the wide portion 450. The thickness of the carrier 418 is dimensioned close to the thickness of the connecting-mid portion 438 of the flange 440 such that a snug fit is provided when the wearable device 416 is connected to the carrier 418. The flange 440 of the wearable device 418 is first inserted into the wide portion 450 and slid toward the narrow portion 452 to secure the wearable device 418 to the carrier 418. Thus, a linear sliding motion is utilized in this embodiment.

Figure 59:
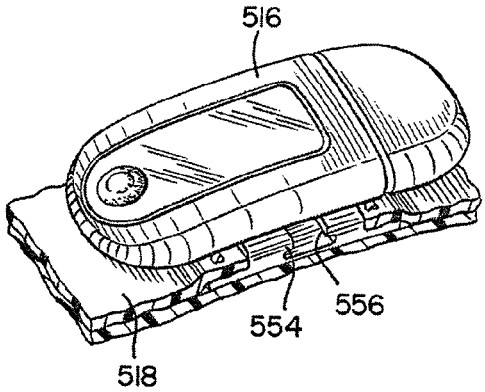
FIG. 59 is a partial perspective view of another embodiment of the wearable device assembly.
Figure 60:
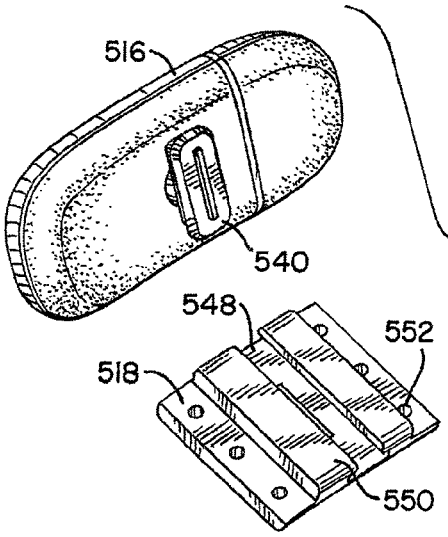
FIG. 60 is a partial exploded perspective view of the assembly of FIG. 59.

In another embodiment depicted in FIGS. 59-62, the wearable device 516 is provided with a flange 540 extending generally perpendicular to the device 516. The carrier 518 is provided with a first raised portion 550 having a lip 554 and a second raised portion 552 having a lip 556. The raised portions 550, 552 and lips 554, 556 form a groove 548. Alternatively, the raised portions and lips can be formed as a uniform groove 548 in the carrier 518 such as shown in FIG. 61. As depicted in FIG. 59, the flange 540 is inserted into the groove 548 by aligning the flange 540 with the groove 548. The flange 540 is then slid along the groove 548 until the wearable device 516 is centered on the carrier 518. The lips 554, 556 engage the upper surface of the flange 540 securing the wearable device 516 to the carrier 518. It is understood other tongue and groove type structures could be utilized to secure the device to the carrier. The groove could also be positioned on the device 516 to cooperate with a tongue structure on the carrier 518.

In FIGS. 63 and 64, another embodiment of the wearable device assembly 614 is depicted. The wearable device 616 is connectable to a carrier 618 in the form of a wristband 618. The device 616 has one end connected to one end of the wristband 618. The connector 623 is inserted into a cap 646 or sleeve 646. The sleeve 646 is connected to the other end of the wristband 618. To expose the connector 623, the device 616 is pulled from the sleeve 646 as shown in FIG. 64. It is understood that the carrier 618 has appropriate structure for securing the band 618 around the wrist.

Figure 66:
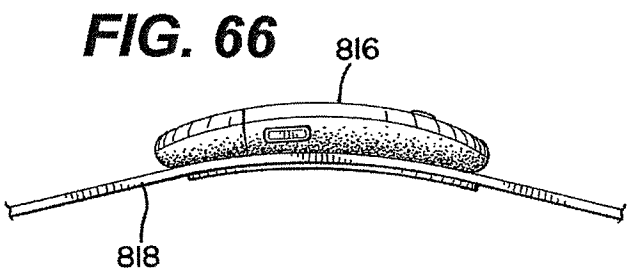
FIG. 66 is a partial side elevation view of the assembly of FIG. 65.
Figure 65:
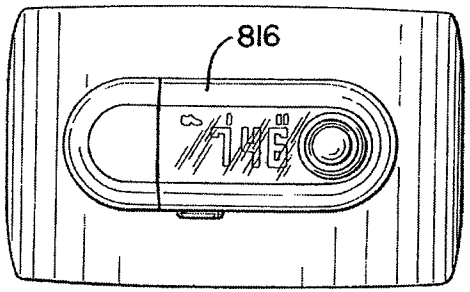
FIG. 65 is a partial plan view of another embodiment of the wearable device assembly.
Figure 67:
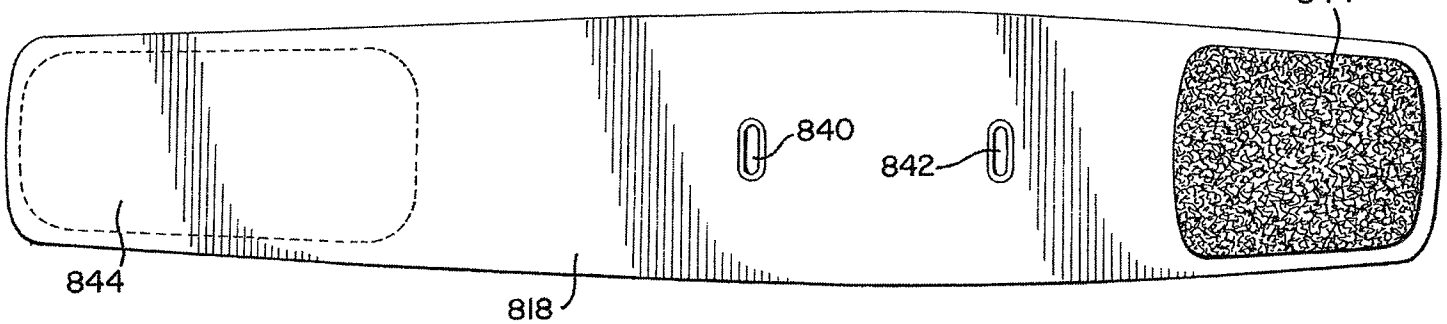
FIG. 67 is a top view of a wristband of the assembly of FIG. 65.
Figures 69A, 69B, 69C, 69D:
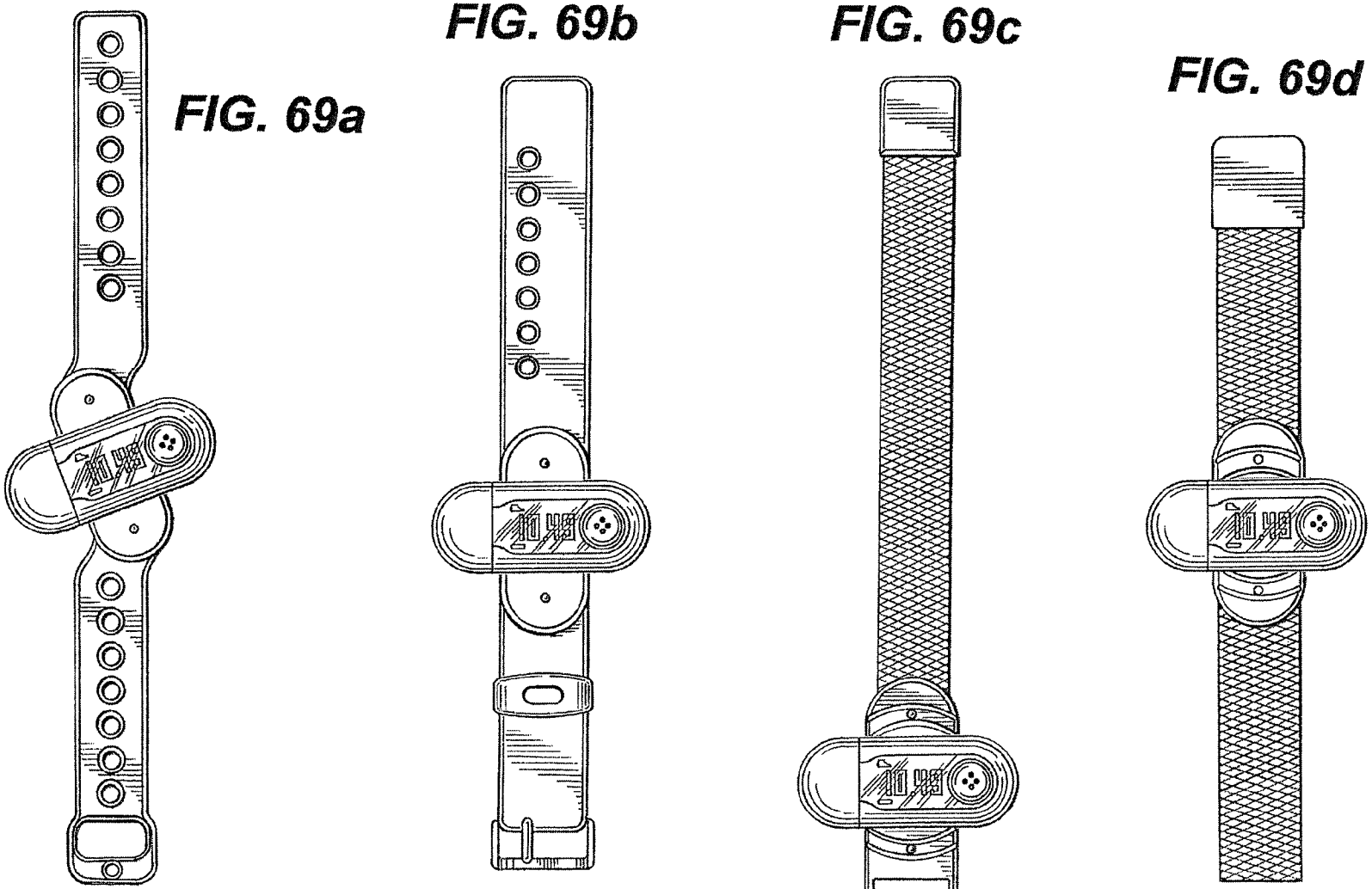
FIGS. 69*a*-69*d* are plan views of additional embodiments of the wearable device assembly.

In another embodiment depicted in FIGS. 65-67, the wearable device 816 is provided with a first connecting protrusion (not shown) and a second connecting protrusion (not shown). Similar to previous embodiments, it is understood that the protrusions extend from the device 816. A carrier in the form of the wristband 818 is provided with a corresponding first receiving slot 840 and a second receiving slot 842. The wearable device 816 connects to the wristband 818 by aligning the first connecting protrusion and the second connecting protrusion with the first receiving slot 840 and the second receiving slot 842. The wristband 818 can also be provided with hook and loop fasteners 844.

FIGS. 68*a* through 68*i* depict various different carrier configurations and, in particular, different wristband arrangements.

In FIG. 68*a*, a wristband 331 is provided with a first strap 332 and a second strap 334. The first strap 332 is provided with a recess 330, a protrusion 336, and several slots. The second strap 334 is also provided with a protrusion 338 and several slots. To secure the wristband 331 to the user's wrist, the end of the second strap 334 is threaded through the recess 330, and the protrusion 338 of the second strap is placed in a slot of the first strap 332. Additionally, the protrusion of the first strap 332 is placed into a slot in the second strap 334.

In another embodiment depicted in FIG. 68*b*, the wristband 338 is provided with a first strap 340 and a second strap 342. The first strap 340 is provided with a protrusion 344, and the second strap is provided with several slots. To secure the wristband around the wrist of the user, the protrusion 344 is placed in one of the several slots located on the second strap. FIG. 68*c* is a variation of the embodiment disclosed in FIG. 68*b* where the first strap is provided with a second protrusion 346. FIG. 68*d* depicts an elastic wristband 348 which adjusts to the user's wrist by stretching to the size and shape of the user's wrist.

FIG. 68*e* depicts another embodiment of a wristband 360 where hook and loop fasteners 362 are provided on the strap members. The wristband is placed around the user's wrist such that the hook and loop fasteners 362 cooperate to secure the strap. FIG. 68*f* shows an alternative embodiment also utilizing hook and loop fasteners 362.

In FIG. 68*g*, another embodiment is depicted. A wristband is provided with an integral strap 374. The integral strap 374 is provided with a tensioner 376. To secure the wristband to the user's wrist, the integral strap 374 is placed on the wrist of the user and the integral strap 374 is pulled through the tensioner 376 to tighten the strap according to the size of the user's wrist. FIG. 68*h* discloses a carrier utilizing both a tensioner 376 and hook and loop fasteners 362.

FIG. 68*i* depicts another embodiment of the wristband. A wristband is provided with a first strap, a second strap. Both the first strap 378 and the second strap 380 are provided with teeth 381. To secure the wristband to the user's wrist, the teeth 381 of the first strap 378 are meshed with the teeth of the second strap 380.

FIGS. 69*a* through 69*d* depict alternative mounting and clasp arrangements of the wearable device assembly of the present invention. The wristbands may have two pin arrangements, traditional watch straps, or straps utilizing hook and loop fasteners. The carriers can also be made of rubber or harder but flexible plastics. The plastic embodiments could also have co-molded components as well as plastics co-molded over fabric materials. It is understood that the devices and wristbands may have one or more of the connecting structures as discussed above.

Figure 70A:
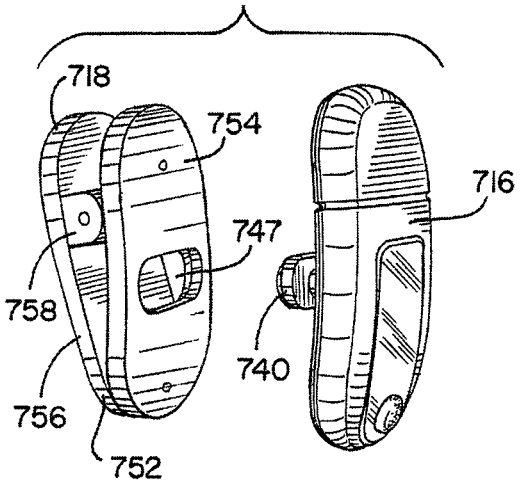
FIG. 70*a* is an exploded view of another embodiment of the wearable device assembly.
Figure 70B:
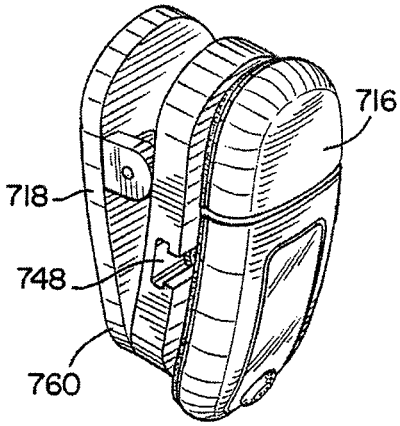
FIG. 70*b* is a perspective view of another embodiment of the wearable device assembly.
Figure 71A:
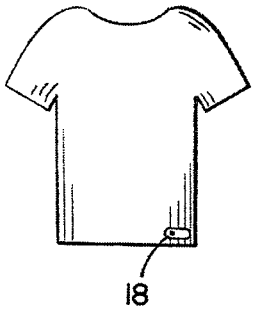
FIGS. 71*a*-71*e* are additional views of carriers used in the wearable device assembly of the present invention.
Figure 71B:
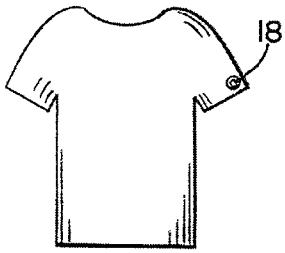
Figure 71C:
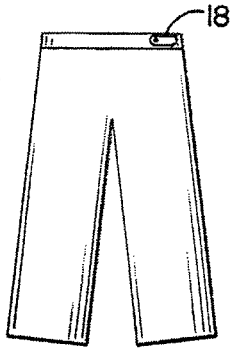
Figure 71D:
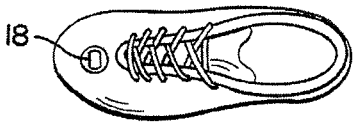
Figure 71E:
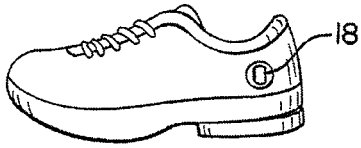
Figure 72A:
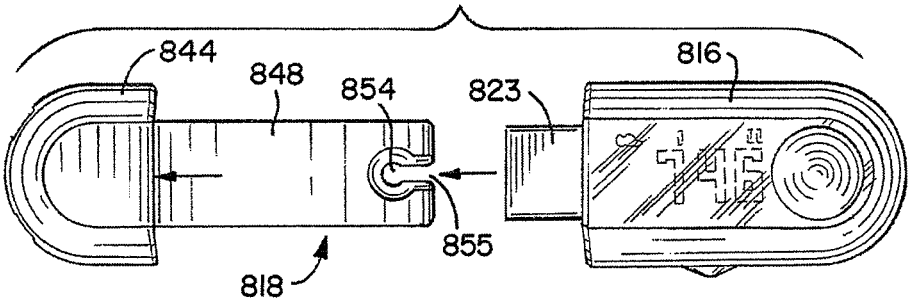
FIG. 72*a* is an exploded front elevation view of an alternative embodiment of a carrier and USB device for the wearable device assembly of the present invention.
Figure 72B:
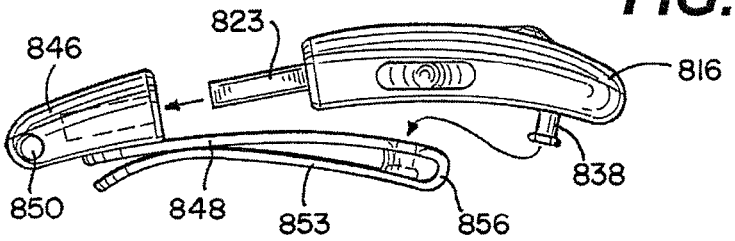
FIG. 72*b* is an exploded side elevation view of the carrier and USB device of FIG. 72*a;*
Figure 73A:
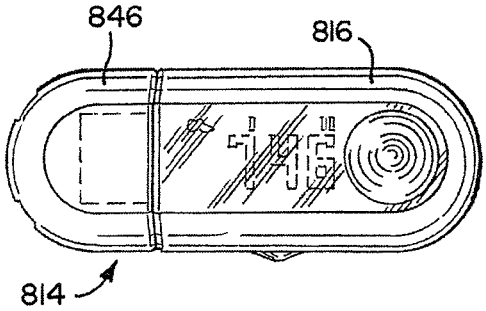
FIG. 73 a is a front elevation view of the embodiment of FIG. 72*a* and having the USB device connected thereto.
FIG. 73*b* is a side elevation view of the embodiment of FIG. 73*a;*
FIG. 73*c* is a rear elevation view of the embodiment of FIG. 73*a;*
Figure 73B:
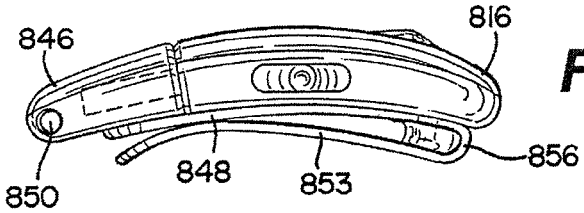
Figure 73C:
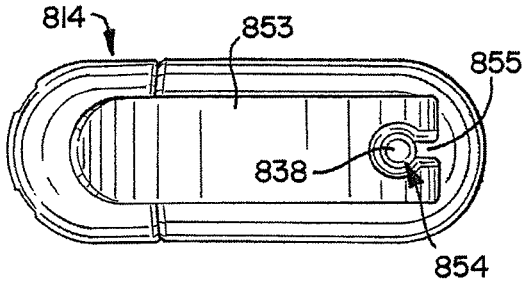

It is further understood that the wearable device can take other forms wherein other carriers are provided. As shown in FIGS. 70*a* and 70*b*, the carrier 718 of the wearable device 716 can be formed in a clip 752. The wearable device 716 is similar in structure and operation to the wearable device assembly shown and described in embodiments having the cooperating slot and flange. The clip 752 includes a first portion 754, a second portion 756, and a spring member 758. The spring member 758 biases the first portion 754 and the second portion 756 together. The first portion 754 includes a slot 747 that receives a flange 740 on the device 716. The wearable device 716 is mounted to the clip 752 in a similar fashion as described above. The clip 752 can be clipped to the user's apparel, otherwise on the person, as well as other locations.

Alternatively as depicted in FIG. 70*b*, a clip 760 can be provided with a uniform groove 748 similar in structure and function to the uniform groove shown above. The wearable device 716 is connected to the clip 760 in similar fashion as the embodiments above wherein a flange slides into the groove 748. The clip 760 can then be clipped to the user's apparel as well as other locations.

As depicted in FIGS. 71*a*-71*e*, the device 16 can be attached to apparel. The carrier 18 can be incorporated into apparel such as shirts, pants and shoes. Other items of apparel are also possible. Other items are also possible such as bags, totes, bands, accessories or any other kind of article worn by a person.

FIGS. 72*a*-74*b* disclose another embodiment of the wearable device assembly, generally designated with the reference numeral 814 and having a different type of carrier. Consistent with the discussion above, the wearable device assembly 814 has the same operable characteristics as the wearable device assembly 14 including communication with the sensor 12 in recording and monitoring athletic performance. The wearable device assembly generally includes a USB type device 816 and a carrier 818. The USB device is generally the same as the device 16 and will not be further described. As further shown in FIGS. 72*a* and 72*b*, the carrier 818 generally has a cap 846 or sleeve 846 attached to a base member 848. The sleeve 846 has an opening to receive the USB device 816 and in particular, the connector 823 of the device 816 as can be appreciated from FIG. 72*b* showing that the connector 823 of the device 816 is received within the sleeve 846. The cap 846 may have an opening or throughway 850 in order to attach a lanyard 852, or another kind of string or rope, to the cap 846. This will be described in greater detail below.

The base member 848 extends from the sleeve 846 in cantilever fashion. The base member has a rounded slot 854 at a distal end of the base member 848. The rounded slot 854 has a peripheral opening 855. As can be appreciated from FIG. 72*a*, the slot 854 is configured to receive a protrusion 838 located on the USB device 816 through the peripheral opening 855. The protrusion 838 is held in the slot 854 in an interference type fit. As further shown in FIG. 72*b*, the base member 848 has an extended portion in the form of a clip member 853. Thus, in one exemplary embodiment, the extended portion is folded over itself defining a folded portion 856 wherein a distal end is positioned proximate the sleeve 846. It is further understood that in an exemplary embodiment, the base member 848 has resilient features wherein the distal end of the base member is biased against the portion of the base member proximate the sleeve 846. It is understood that in an exemplary embodiment, the slot 854 is positioned completely through the base member 848 at the folded portion 856.

Figure 74A:
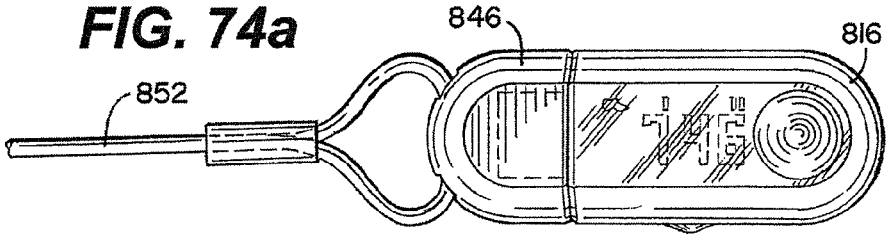
FIG. 74*a* is a front view of the embodiment of FIG. 73*a* and having a lanyard connected thereto.
Figure 74B:
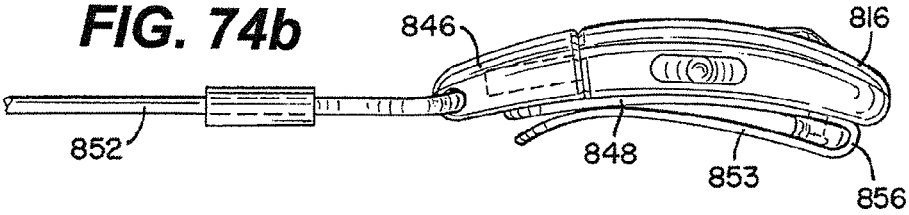
FIG. 74*b* is a side view of the embodiment shown in FIG. 74*a;*

As shown in FIGS. 74*a* and 74*b*, the lanyard 852 may attach to the sleeve 846 through the throughway 850. The USB device 816 has its connector 823 inserted into the opening of the sleeve 846 wherein the protrusion 838 on the device 816 is received in the slot 854 through the peripheral opening 855 in an interference type fit. The USB device 816 is then secured to the carrier 818. A user may then carry the wearable device assembly 814 with the lanyard 852 around their neck, wrist, or ankle. Alternatively, a user may use the clip member 853 to attach the wearable device assembly 814 to another object such as various pieces of clothing, such as shirts, pants, socks, shoes, or hats. Connection to other objects such as bags etc. is also possible. The clip member 853 is forced over the object wherein the resilient features of the clip member sufficiently hold the clip member 853 to the object. It is understood that the operation of the wearable device assembly 814 is identical to the assembly 14 as described above.

Figure 75A:
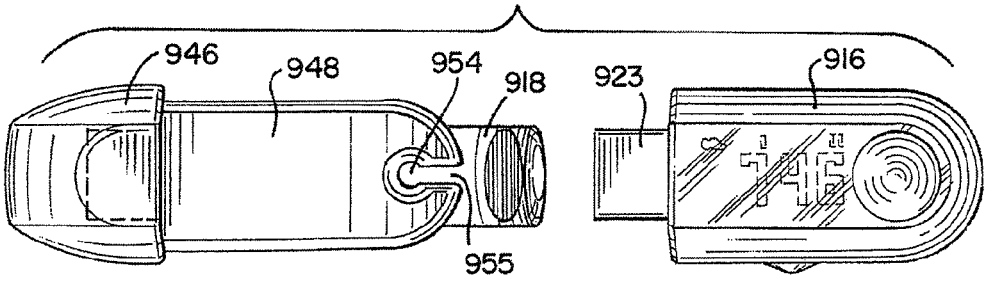
FIG. 75*a* is an exploded front elevation view of an alternative embodiment of a carrier and USB device for the wearable device assembly of the present invention.
Figure 75B:
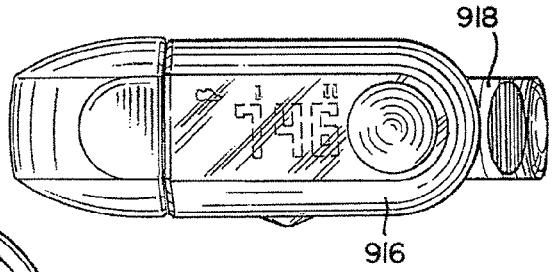
FIG. 75*b* is a front elevation view of the embodiment of FIG. 75*a* and having the USB device connected thereto.
Figure 75B:
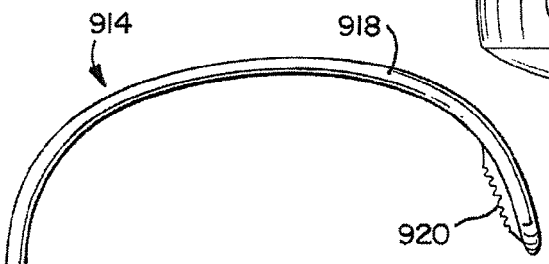
Figure 75C:
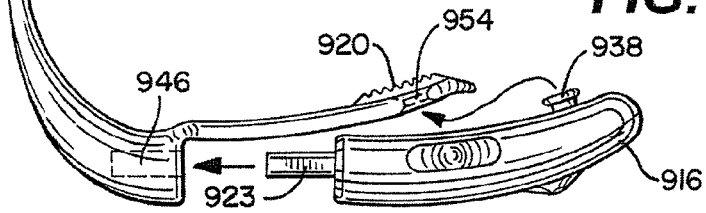
FIG. 75*c* is a side elevation view of the embodiment of FIG. 75*a;*
Figures 76, 77A, 77B, 77C:
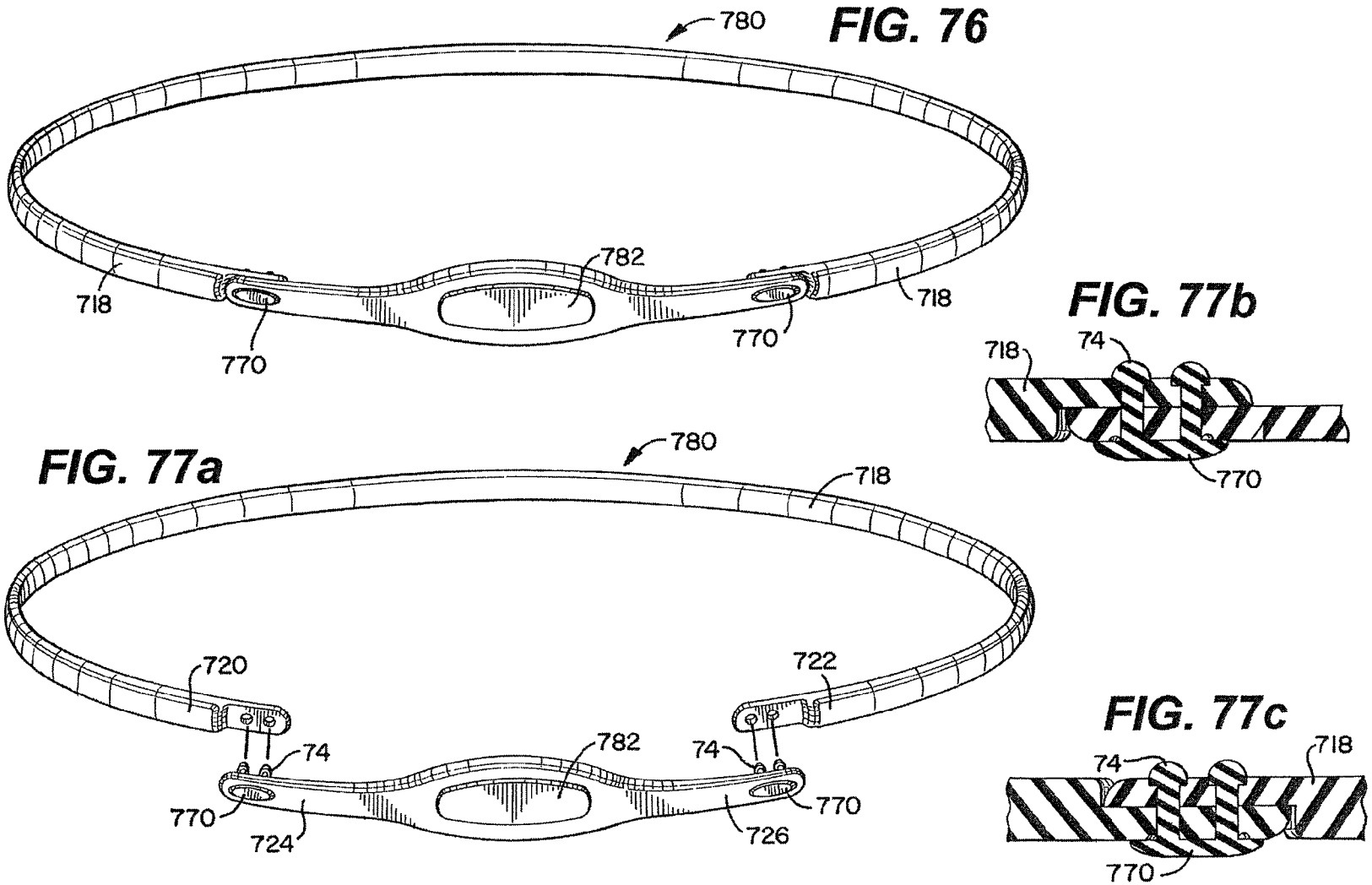
FIG. 76 is a perspective view of an embodiment of a heart-rate monitor assembly with a removable closure assembly.
FIG. 77*a* is an exploded perspective view of the heart-rate monitor assembly of FIG. 76.
FIGS. 77*b* & 77C are partial cross-sectional views of the removable closure assembly of FIG. 76.

FIGS. 75*a*-75*c* disclose another embodiment of the wearable device, generally designated with the reference numeral 914 and having a different type of carrier which may be configured to fit over a wrist of a user. Consistent with the discussion above, the wearable device assembly 914 has the same operable characteristics as the wearable device assembly 14 including communication with the sensor 12 in recording and monitoring athletic performance. The wearable device assembly generally includes a USB type device 916 and a band 918.

As shown in FIG. 75*c*, the band 918 has a sleeve 946, a base member 948, a first end and a second end. A gap may be located between the first end and second end, wherein the gap is sized such that a wrist may slide through the gap. The sleeve 946 may be attached to the base member 948. The sleeve 946 has an opening to receive the USB device 916 and in particular, the connector 923 of the device 916 as can be appreciated by FIGS. 75*a* and 75*c* showing that the connector 923 of the device 916 is received within the sleeve 946.

The base member 948 extends from the sleeve 946. The base member 948 has a rounded slot 954 has a peripheral opening 955. As can be appreciated from FIG. 75*a*, the slot 954 is configured to receive a protrusion 938 located on the USB device 916 through the peripheral opening 955. The protrusion 938 is held in the slot 954 in an interference type fit. In an alternative embodiment, the rounded slot 954 may not have a peripheral opening 955, wherein the protrusion 938 may be held in the slot 954 with an interference fit against the pad member 920 located on the first end of the band 918.

As shown in FIG. 75*c*, the first end and the second end each have a pad member 920. The pad member 920 may provide additional friction against the user's wrist in order to keep the band 918 in place on the user's wrist. The pad member 920 may be made of a rubber, nylon or plastic material. Those of skill in the art will appreciate that the pad member 920 may be made of any material which comfortably provides friction against the user's wrist in order to keep the band 918 in place on the user's wrist. The band 918 may be rigid and in the shape of an oval in order to fit over the wrist. The rigid structure of the band 918 may also help keep the band 918 in place on the user's wrist.

FIGS. 76-79 depict another embodiment of the removable closure for a heart-rate monitor assembly 780. The heart-rate monitor assembly 780 has a chest strap 718 and a transmitter portion 782. The chest strap 718 has a first end 720 and a second end 722, while the transmitter portion 782 also has a first end 724 and a second end 726. The transmitter portion 782 has at least two removable closures 770 which are used to fasten the chest strap 781 to the transmitter portion 782. The removable closure 770 is generally similar in structure to the removable closure 70 described above and shown in FIGS. 4 and 15. One removable closure 770 is attached to the first end 724 of the transmitter portion 782 and one removable closure 770 is attached to the second end 726 of the transmitter portion 782. To this end, the removable closures 770 cooperate with a plurality of holes on the first end 720 and the second end 722 of the chest strap 781.

Figure 4:
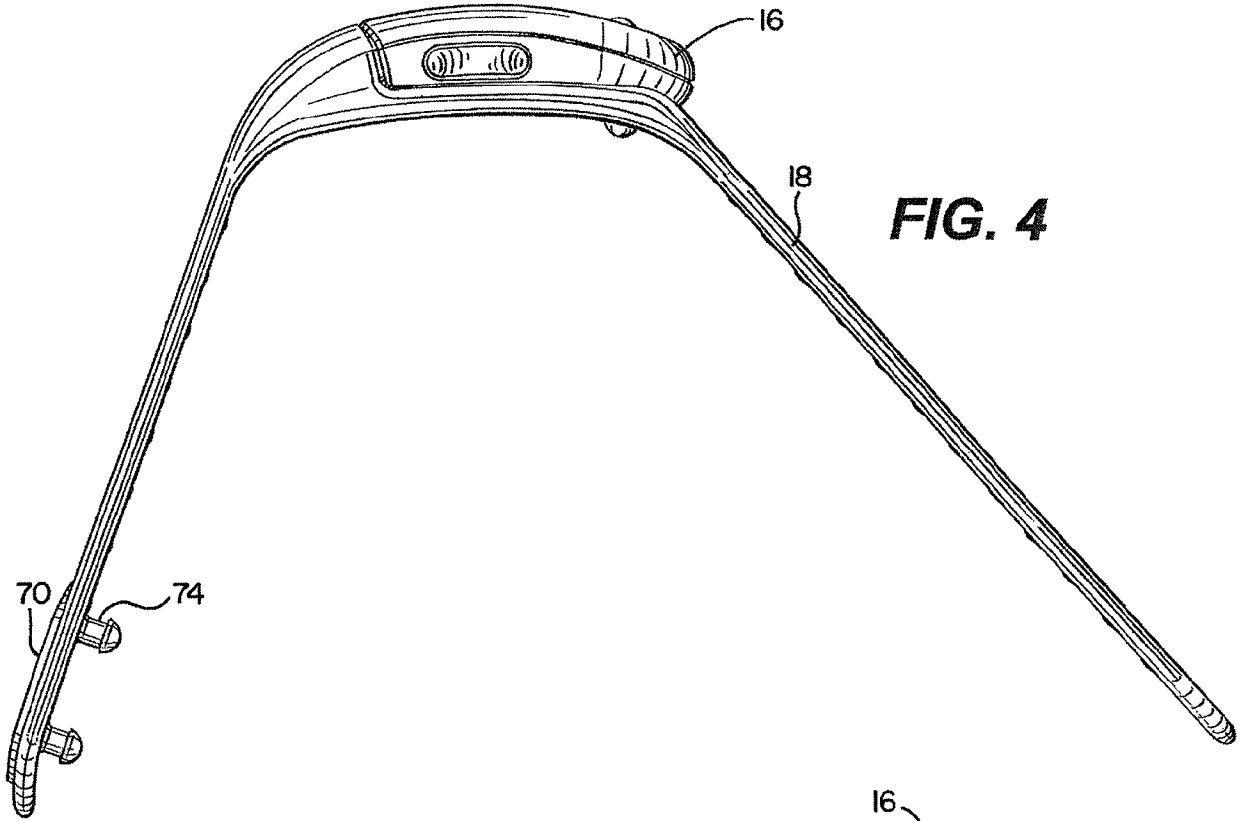
FIG. 4 is a side elevation view of the device assembly shown in FIG. 3.
Figure 5:
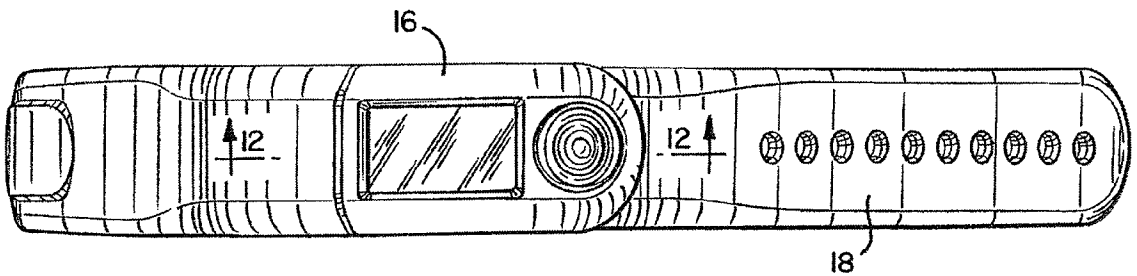
FIG. 5 is a plan view of the device assembly shown in FIG. 3.
Figure 6:
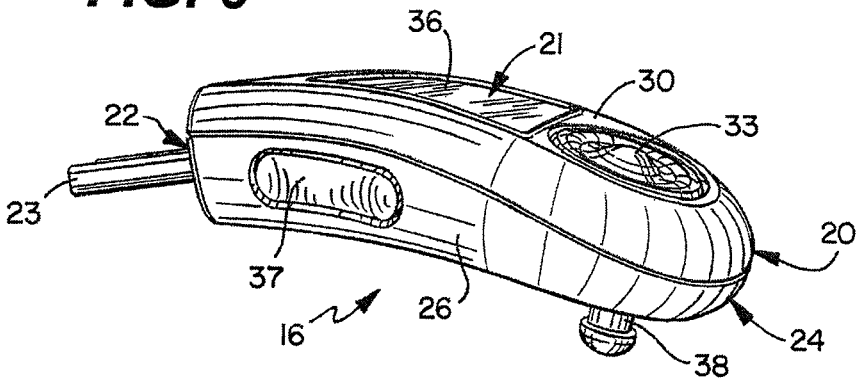
FIG. 6 is a perspective view of a USB-type device of the wearable device assembly.
Figure 7:
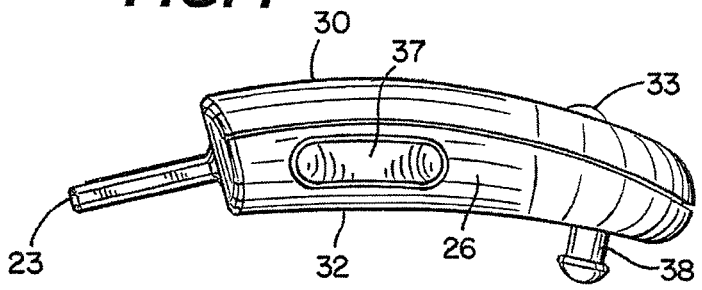
FIG. 7 is a side elevation view of the device shown in FIG. 6.
Figure 8:
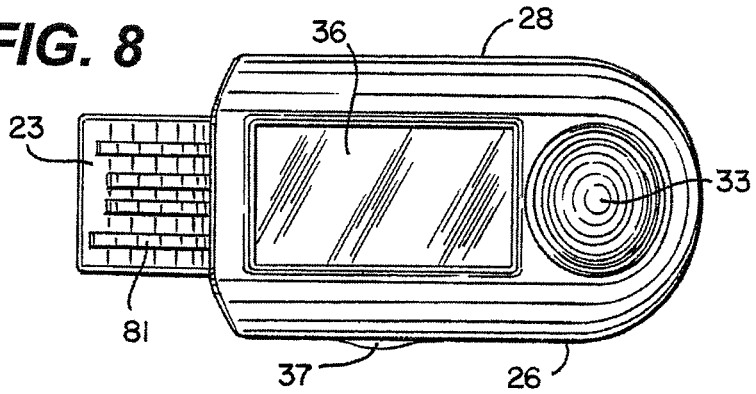
FIG. 8 is a top plan view of the device shown in FIG. 6.

As discussed, the removable closure 770 used with the heart-rate monitor assembly may be very similar to the removable closure 70 as depicted in FIGS. 4 and 15. The removable closure 770 may have a plate member 72 and a plurality of posts 74 extending generally in a perpendicular direction from the plate member 72. As is depicted in FIGS. 15, 16 and 77*a*-77*c*, the plate member 72 has two posts 74. Each post 74 has an insert 76 that is pressed on or snap fitted onto the post 74. Each insert 76 is spot welded to the plate member 72. Other connection methods are possible. A gap is maintained between an inside surface of the plate member 72 and a bottom surface of the post 74. In addition, each post 74 has an annular channel 78 around a periphery of the post 74.

Figure 79:
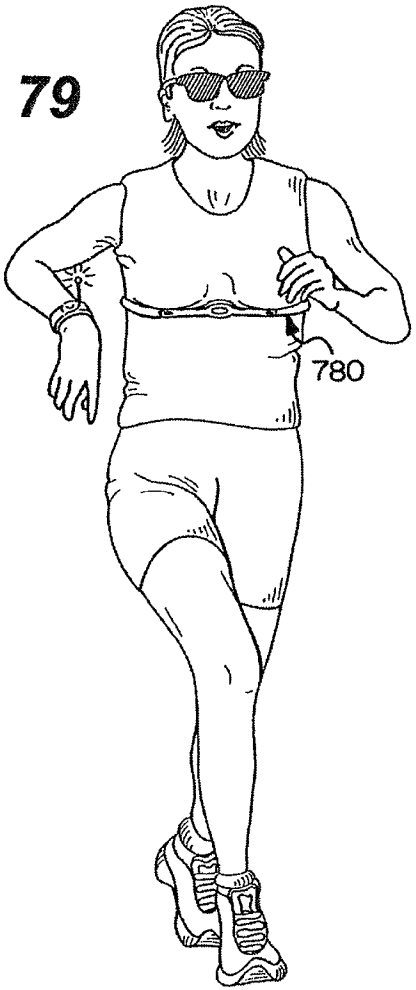
FIG. 79 is a front view of a user with the heart-rate monitor assembly of FIG. 76.
Figure 78:
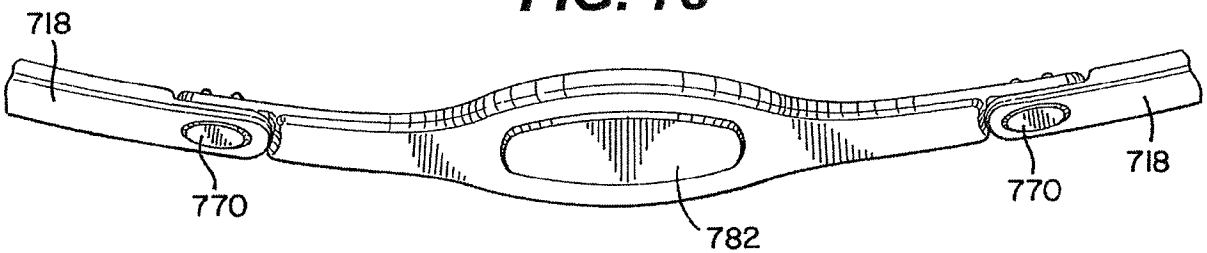
FIG. 78 is a partial perspective view of the heart-rate monitor assembly of FIG. 76.

To wear the heart-rate monitor assembly 780, as depicted in FIG. 79, first the first removable closure 770 is connected to the first end 724 of the transmitter portion 782 wherein a pair of holes is provided to receive the posts 74. Next, the first removable closure 770 is connected to the first end 720 of the chest strap 781 by inserting the posts 74 into the holes provided on the first end 720 of the chest strap 781. The chest strap 781 is then positioned around the user's chest. Next, in order to fasten the heart rate monitor assembly 780 around the user's chest, the second removable closure 770 is connected to the second end 726 of the transmitter portion 782 wherein a pair of holes is provided to receive the posts 74. Next, the second removable closure 770 is connected to the second end 722 of the chest strap 781 by inserting the posts 74 into the holes provided on the second end 722 of the chest strap 781. With the use of the pair of posts 74, the removable closure 770 allows for a secure connection and greater flexibility in connection providing for a greater adjustment to accommodate for a range of chest sizes.

As discussed earlier, the plate member 72 of the removable closure 770 can have indicia 73 thereon. The plate member 72, when attached to the chest strap 781 and transmitter portion 782, faces away from the chest strap 781, wherein the indicia 73 can be viewed by others. Because the removable closure 770 is easily removable, the closure 770 can be used as a memento and different closures can be provided and used with the heart-rate monitor assembly 780. Thus, removable closures having different indicia can be provided and used as a keepsake, memento, or reward for accomplishing a goal, participating in a race, or otherwise achieving a certain level of fitness. Indicia can take various forms including wording, graphics, color schemes, textures, or other designs, etc. Also, as a pair of removable closures 770 is utilized in one exemplary embodiment, the indicia included on each removable closure 770 can provide for an overall unitary message as desired.

The present invention includes several different embodiments having a variety of different features as disclosed herein. It is understood that additional embodiments within the scope of the invention are possible that may utilize a combination of the various different features of the embodiments disclosed herein.

Conclusion

While the invention has been described with respect to specific examples including presently preferred modes of carrying out the invention, those skilled in the art will appreciate that there are numerous variations and permutations of the above described systems and methods. For example, various aspects of the invention may be used in different combinations and various different subcombinations of aspects of the invention may be used together in a single system or method without departing from the invention. Also, various elements, components, and/or steps described above may be changed, changed in order, omitted, and/or additional elements, components, and/or steps may be added without departing from this invention. Thus, the invention should be construed broadly as set forth in the appended claims.

What is claimed is:

1. A wearable assembly configured to be used by a user wearing a sensor, the wearable assembly comprising:

a wristband having a central portion between a first end portion and a second end portion, the first end portion having a pair of holes and the second end portion having a plurality of holes, the central portion having an aperture and a sleeve with an opening; and a data transfer module having a housing, a protrusion, and a data connector operably connected to a controller positioned within the housing, the controller configured to communicate athletic performance data received from the sensor, wherein the athletic performance data includes time, speed, and distance, the housing having a first member and a second member, wherein the protrusion is protruding from the second member, the housing further having a first push button operably associated with the controller and a second push button operably associated with the controller, wherein the first member is connected to the second member by an epoxy member positioned between a periphery of the members, and further wherein the second member has a plurality of leads embedded in plastic at one end defining the data connector, the leads in operable communication with the controller, wherein the data transfer module is connected to the wristband wherein the protrusion is received by the aperture and the data connector is received by the sleeve through the opening.

2. The wearable assembly of claim 1 wherein the controller records and monitors athletic performance data.

3. The wearable assembly of claim 2 where in response to plugging the data connector into the computer, data stored on the data transfer module is automatically uploaded to a remote website for display.

4. The wearable assembly of claim 1 further including a removable closure having a plate member and a pair of posts extending from the plate member, wherein the pair of posts is received in the pair of holes of the first end portion and further received in respective holes of the plurality of holes of the second portion to fasten the first end portion with the second end portion.

5. The wearable assembly of claim 1 wherein the sleeve encompasses the data connector and is positioned proximate that central portion of the wristband.

6. The wearable assembly of claim 1 wherein the aperture is positioned proximate the central portion of the wristband.

7. The wearable assembly of claim 1 further including a display in communication with the controller.

8. The wearable assembly of claim 1 wherein the first push button adapted to cooperate with a first input of the controller.

9. The wearable assembly of claim 1 wherein the first push button is integral with the housing, providing a sealed structure of the housing around the first push button of the housing.

10. The wearable assembly of claim 1 wherein the second member has a peripheral groove, wherein the first member is connected to the second member by the epoxy member positioned in the groove.

* * * * *